US011000874B2

(12) United States Patent
McPeek

(10) Patent No.: US 11,000,874 B2
(45) Date of Patent: May 11, 2021

(54) VORTEX FOUNTAIN SYSTEM WITH SECONDARY VISUAL EFFECT

(71) Applicant: Marshall McPeek, Columbus, OH (US)

(72) Inventor: Marshall McPeek, Columbus, OH (US)

( * ) Notice: Subject to any disclaimer, the term of this patent is extended or adjusted under 35 U.S.C. 154(b) by 20 days.

(21) Appl. No.: 15/683,820

(22) Filed: Aug. 23, 2017

(65) Prior Publication Data

US 2018/0056320 A1 Mar. 1, 2018

Related U.S. Application Data

(63) Continuation of application No. 29/598,129, filed on Mar. 23, 2017, now Pat. No. Des. 835,751.

(60) Provisional application No. 62/485,683, filed on Apr. 14, 2017, provisional application No. 62/381,320, filed on Aug. 30, 2016.

(51) Int. Cl.

| | |
|---|---|
| ***B05B 17/08*** | (2006.01) |
| ***B04C 9/00*** | (2006.01) |
| ***B04C 3/00*** | (2006.01) |

(52) U.S. Cl.

CPC ..... *B05B 17/08* (2013.01); *B04C 3/00* (2013.01); *B04C 9/00* (2013.01)

(58) Field of Classification Search

CPC ..... B04C 3/00; B04C 3/06; B04C 2003/002; B04C 2003/006; B05B 17/08; Y10T 137/2087; Y10T 137/2098; G09B 23/00

USPC ..... 434/126, 302

See application file for complete search history.

(56) References Cited

U.S. PATENT DOCUMENTS

| | | | | |
|---|---|---|---|---|
| 1,782,944 A * | 11/1930 | Stanford | G09F 13/24 40/407 |
| 2,519,736 A | 8/1950 | Bradley | |
| 4,258,912 A * | 3/1981 | Reighart, II | A63H 33/42 40/408 |
| 4,452,562 A * | 6/1984 | Hsu | F03D 1/04 415/208.1 |
| 4,490,931 A * | 1/1985 | Fleemin | G09F 19/00 40/406 |
| D293,128 S | 12/1987 | Karamian | |
| D319,487 S | 8/1991 | Lougee et al. | |

(Continued)

FOREIGN PATENT DOCUMENTS

GB 3004089 5/2002

OTHER PUBLICATIONS

Endless vortex water fountain, Published May 3, 2016[onling], [site visited Feb. 25, 2021]. Available from internet, URL: <https://odditymall.com/vortex-water-fountain> (Year:2016) (Year: 2016).*

(Continued)

*Primary Examiner* — Qingzhang Zhou
*Assistant Examiner* — Christopher R Dandridge
(74) *Attorney, Agent, or Firm* — Standley Law Group LLP

(57) ABSTRACT

A fountain for creating a vortex includes a base housing with a lower reservoir therein. A pump moves water from the lower reservoir into a cylindrical upper tank located on a support platform. Tubing connects the pump to an elbow fitting, which extends through an inflow hole in the support platform. The elbow fitting ejects water into the tank along the sidewall immediately adjacent to said elbow fitting so as to fill the tank with water and create the vortex. Water eventually drains through a drain hole in the center of the support platform and returns to the lower reservoir.

18 Claims, 37 Drawing Sheets

(56) References Cited

U.S. PATENT DOCUMENTS

| | | | | |
|---|---|---|---|---|
| D319,488 | S | 8/1991 | Lougee et al. | |
| D394,301 | S | 5/1998 | Fisher | |
| D420,423 | S | 2/2000 | Blount | |
| 6,207,064 | B1 * | 3/2001 | Gargas | B01F 3/0446 210/205 |
| 6,439,471 | B2 | 8/2002 | Ehrlich et al. | |
| 6,527,197 | B1 * | 3/2003 | Lin | B05B 17/08 239/16 |
| D497,659 | S | 10/2004 | Bright et al. | |
| D503,833 | S | 4/2005 | Bright et al. | |
| 6,921,023 | B1 * | 7/2005 | Bright | F21S 8/00 239/17 |
| 6,971,779 | B2 | 12/2005 | Tau et al. | |
| 7,341,203 | B1 | 3/2008 | Yeomans et al. | |
| D582,509 | S | 12/2008 | Konkle | |
| 7,905,728 | B2 * | 3/2011 | Piontek | G09B 23/12 366/273 |
| D640,344 | S | 6/2011 | Hadi | |
| D689,978 | S | 9/2013 | Mei Ying | |
| D697,580 | S | 1/2014 | Hadi | |
| D841,769 | S | 2/2019 | Tappeiner | |
| D841,770 | S | 2/2019 | Tappeiner | |
| 10,478,831 | B1 | 11/2019 | Soin et al. | |
| 2001/0036609 | A1 | 11/2001 | Ehrlich et al. | |
| 2007/0187523 | A1 | 8/2007 | Bond | |
| 2008/0099574 | A1 | 5/2008 | Lin | |
| 2018/0015428 | A1 | 1/2018 | Nardella | |
| 2018/0243761 | A1 | 8/2018 | Hashimoto | |

OTHER PUBLICATIONS

William Pye, Charybdis II, 2012, http://www.williampye.com/works/charybdis-ii-oman.

William Pye, Caribdis, 2012, http://www.williampye.com/works/caribdis.

William Pye, Aquabar, 2003, http://www.williampye.com/works/aquabar.

William Pye, Mini Vortex, http://www.williampye.com/works/mini-vortex, site visited Jul. 27, 2017.

William Pye, Scylla, 2001, http://www.williampye.com/works/scylla.

William Pye, Charybdis, 2000, http://www.williampye.com/works/charybdis.

HY8812 Cyclone, posted Aug. 6, 2018 [online], [retrieved Jan. 6, 2021]. Retrieved from internet, https://www.youtube.com/watch?v=pyJjLSy4OtY&feature=emb_logo (on or around timestamp 0:11 into the video).

Quox Creek Vortex, announced Dec. 4, 2017[online], [site visited Jan. 6, 2021], Available from internet, URL:<https://www.amazon.com/Quox-Creek-Vortex-Fountain-Tabletop/dp/B077WMY641> (Year: 2017).

Endless vortex water fountain, Published May 3, 2016[onling], [site visited Jan. 6, 2021]. Available from internet, URL: <https://odditymall.com/vortex-water-fountain> (Year:2016).

* cited by examiner 300
308
310
302

FIG. 38B
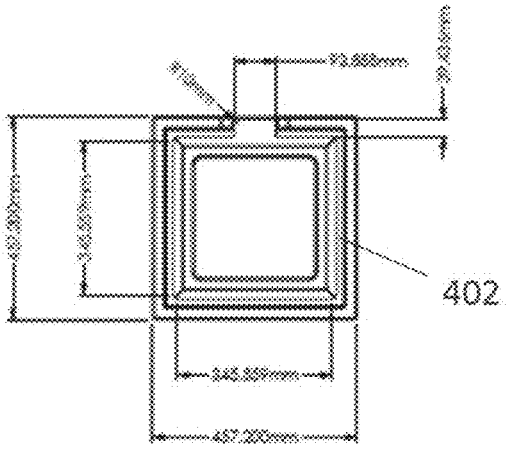
FIG. 38A
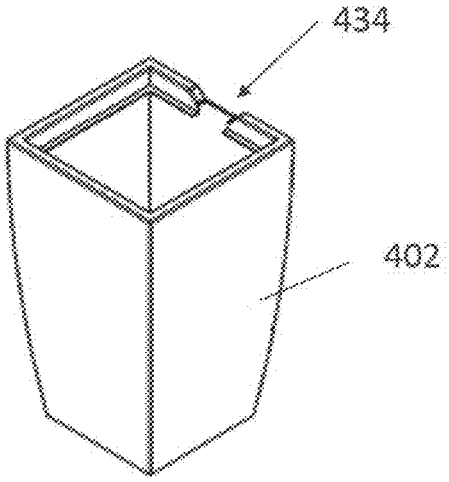
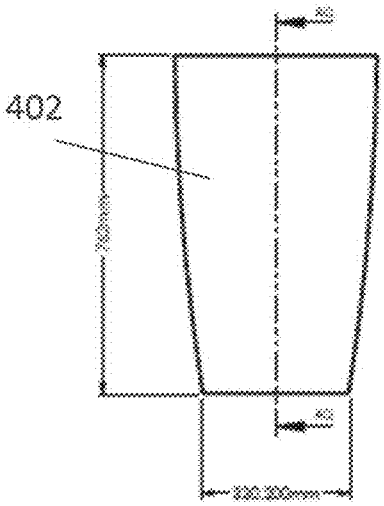
FIG. 38C
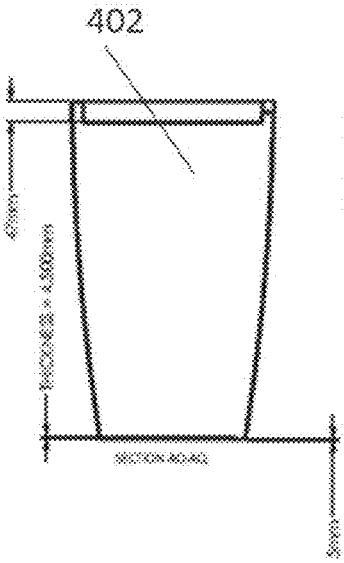
FIG. 38D
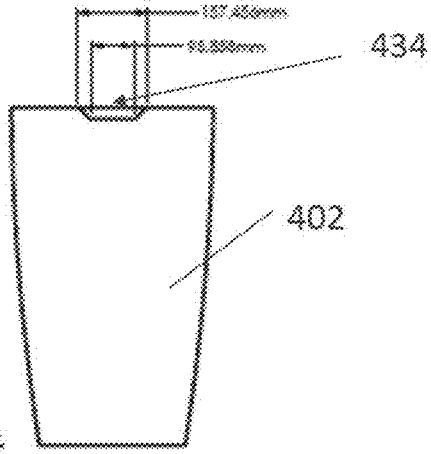
FIG. 38E

SURFACE FINISHING NOTE

402

ROUGH TEXTURE APPEARANCE

TEXTURE AND COLOR NEEDS TO LOOK LIKE THIS IMAGE SAMPLE.

FIG. 40B
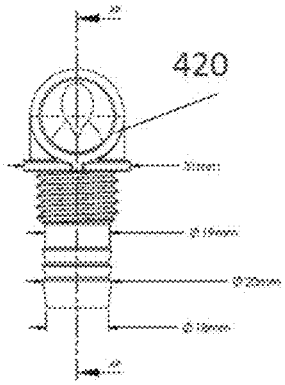
FIG. 40C
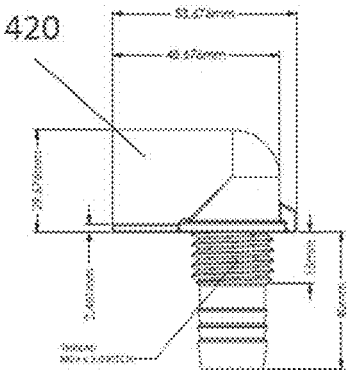
FIG. 40D
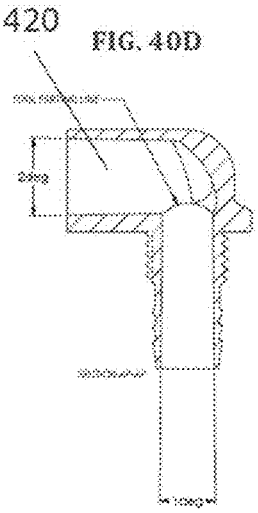
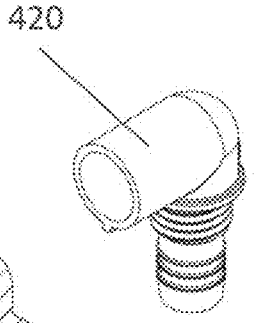
FIG. 40A
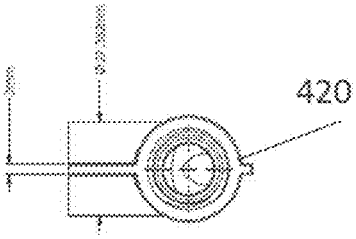
FIG. 40E FIG. 41B
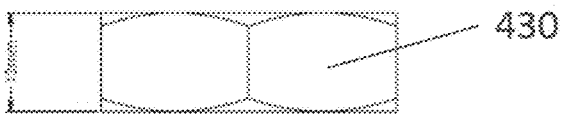
FIG. 41A
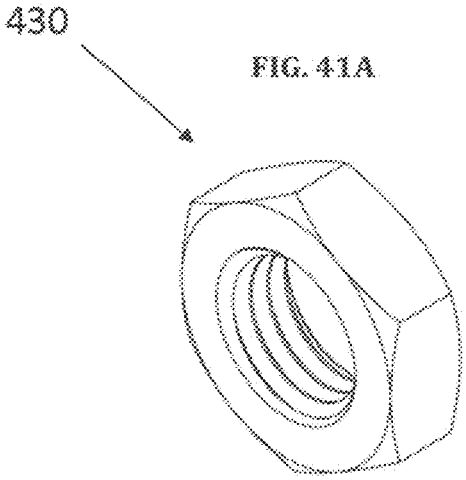
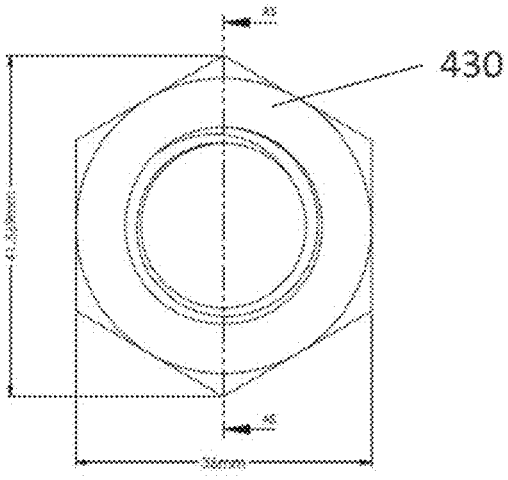
FIG. 41C
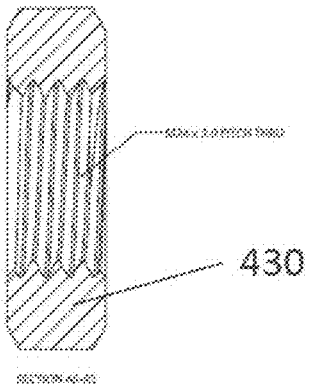
FIG. 41D

VORTEX FOUNTAIN SYSTEM WITH SECONDARY VISUAL EFFECT

CROSS-REFERENCE TO RELATED APPLICATIONS

This application claims the benefit of and priority to U.S. Provisional Patent Application Ser. No. 62/381,320 filed Aug. 30, 2016, U.S. Provisional Patent Application Ser. No. 62/485,683 filed Apr. 14, 2017, as well as U.S. Design patent application Ser. No. 29/598,129 filed Mar. 23, 2017, the disclosures of which are all hereby incorporated by reference in their entirety.

TECHNICAL FIELD

The present invention relates to fountains.

BACKGROUND AND SUMMARY OF THE INVENTION

Water fountains are widely used in both commercial and residential settings for their visual displays and relaxing sounds. There is always an interest in fountains that have unique and unexpected displays. Exemplary embodiments herein pertain to vortex fountains that may be used in commercial and residential settings. Vortex fountains have a swirling vortex of water in the middle of the fountain that mimics a tornado or deep whirlpool. Exemplary embodiments pertain to vortex fountains that are stable and resistant to wobbling.

BRIEF DESCRIPTION OF THE DRAWINGS

A better understanding of the exemplary embodiments will be obtained from a reading of the following detailed description and the accompanying drawings; wherein:

FIG. 37B is a side view of the assembly of FIG. 37A also indicating section line AT-AT;

FIG. 38A is a perspective view of an exemplary base housing for use with the present invention;

FIG. 38B is a top view of the base housing of FIG. 38A;

FIG. 38C is a side view of the base housing of FIG. 38A also indicating section line AG-AG;

FIG. 38D is a side sectional view of the base housing of FIG. 38A taken along section line AG-AG of FIG. 38C;

FIG. 38E if a rear view of the base housing of FIG. 38A;

FIG. 40A is a front perspective view of an exemplary elbow joint for use with the present invention;

FIG. 40B is a front view of the elbow joint of FIG. 40A also indicating section line AP-AP;

FIG. 40C is a side view of the elbow joint of FIG. 40A;

FIG. 40D is a side sectional view taken along section line AP-AP of FIG. 40B;

FIG. 40E is a bottom view of the elbow joint of FIG. 40A;

FIG. 41A is a perspective view of nut for use with the present invention;

FIG. 41B is a side view of the nut of FIG. 41A;

FIG. 41C is a top view of the nut of FIG. 41A also indicating section line AS-AS;

FIG. 41D is a side sectional view taken along section line AS-AS of FIG. 41C;

DESCRIPTION OF THE PREFERRED EMBODIMENTS

Figure 1:
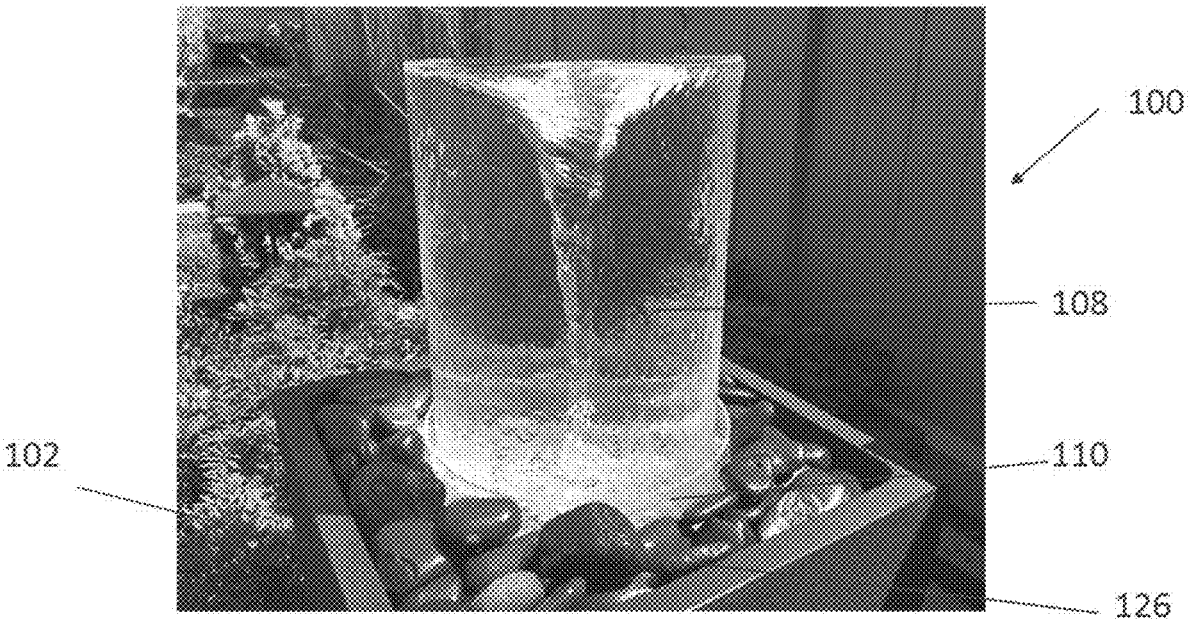
FIG. 1 is a perspective view of a fountain of a first embodiment in operation.
Figure 2:
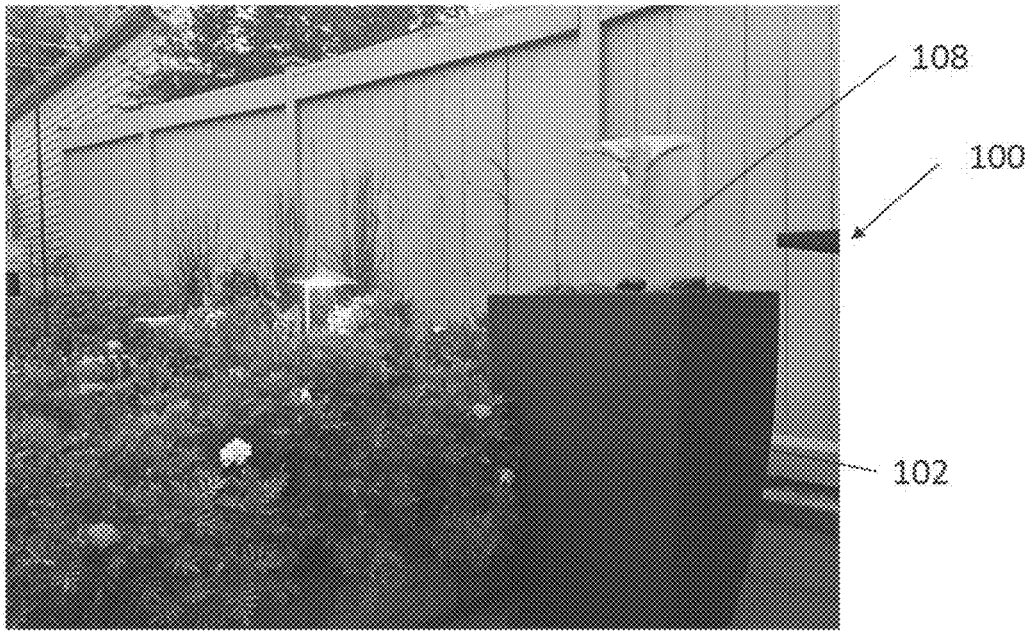
FIG. 2 is a perspective view of the fountain of FIG. 1.
Figure 3:
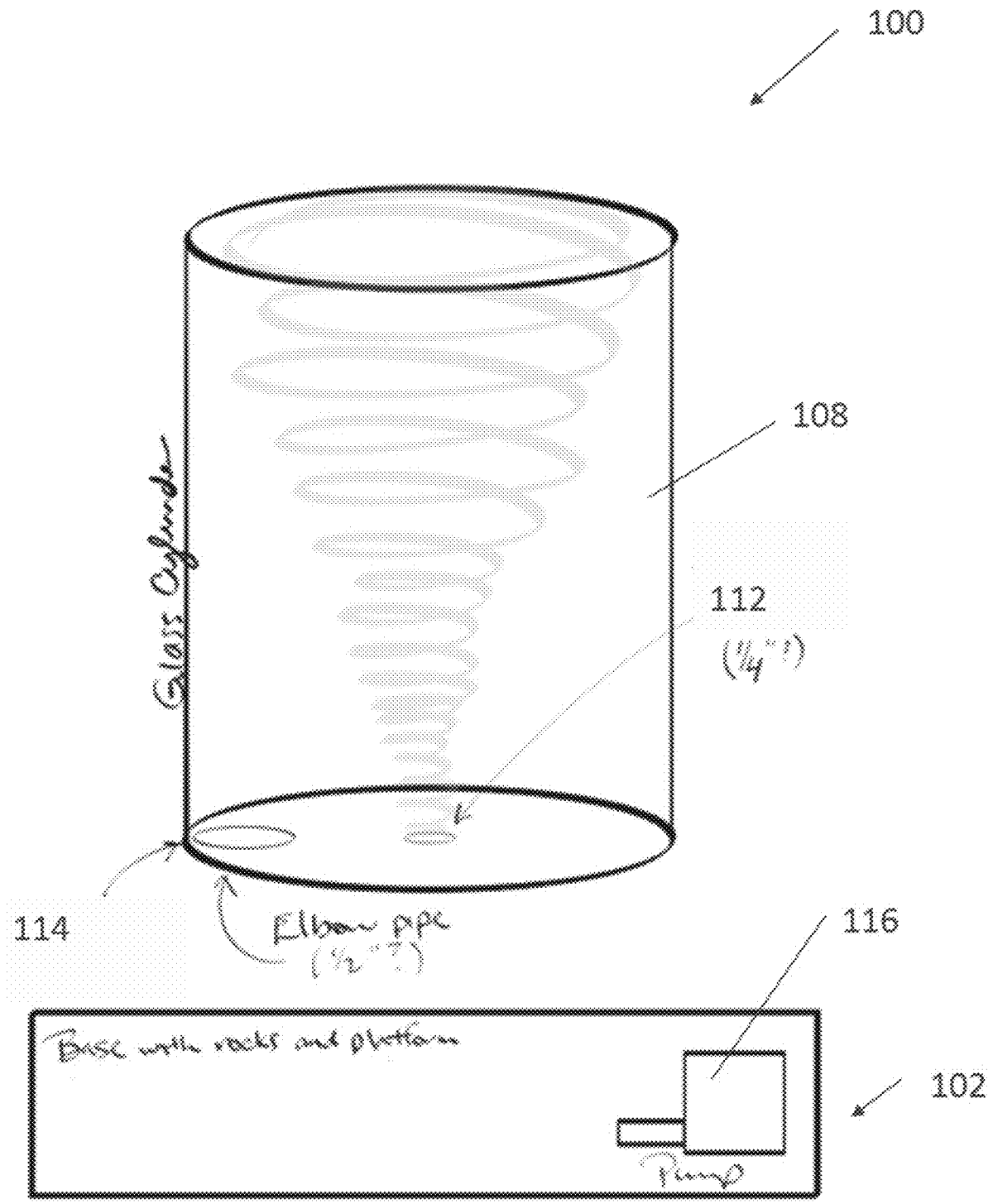
FIG. 3 is an illustration of certain exemplary components of an embodiment of a fountain.
Figure 4:
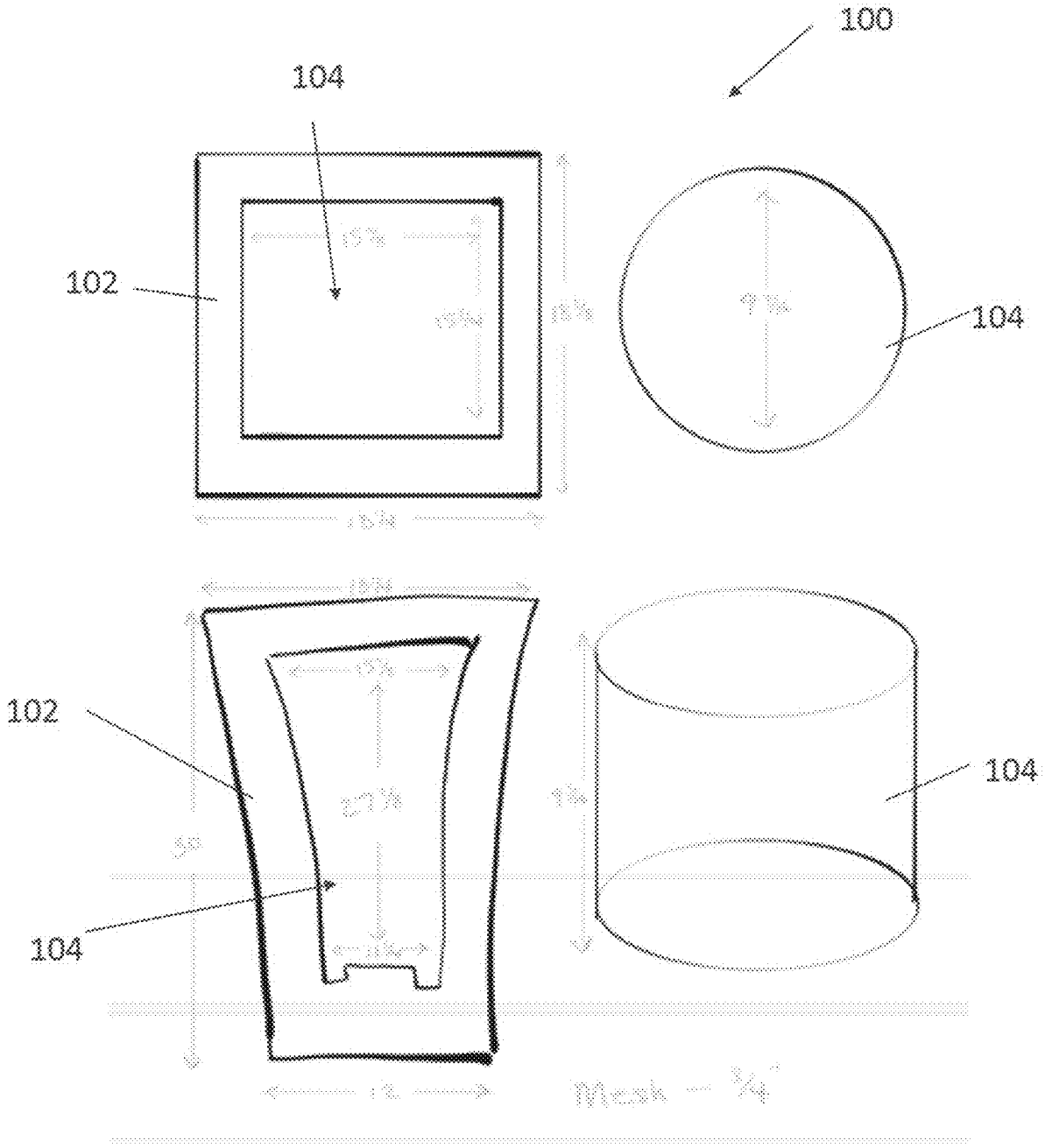
FIG. 4 is an illustration of certain exemplary components of an embodiment of a fountain.
Figure 5:
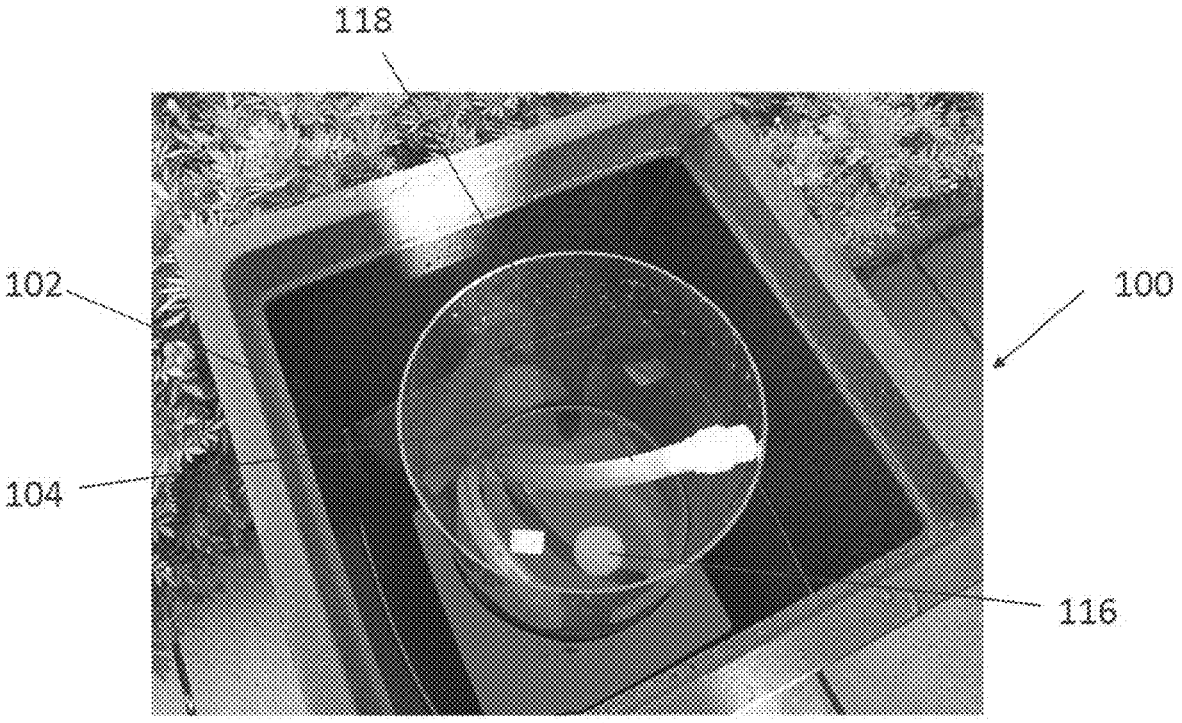
FIG. 5 is a perspective view of the partially disassembled fountain of FIG. 1, showing an exemplary base housing, lower reservoir, and tubing.

FIG. 1 through FIG. 13 illustrates a first embodiment of a fountain 100. In this embodiment, the fountain device 100 is comprised of a base housing 102, a lower reservoir 104 contained within the base housing 102, a support rack 106 positioned horizontally near the top of said base housing 102, and a cylindrical upper tank 108 located on the support rack 106 that extends upward out of the base housing 102. An outer ring 110 that surrounds the upper tank 108 is positioned on the support rack 106 around the upper tank 108. In this embodiment, the upper tank 108 and lower reservoir 104 are cylindrical, though any shape is contemplated. The upper tank 108 and lower reservoir 104 each have a bottom surface but no top surface. The upper tank 108, outer ring 110, and lower reservoir 104 are aligned on the same longitudinal axis, though such is not required.

The upper tank 108 may have two apertures on its bottom surface. One is a drain hole 112 located in the middle of the bottom surface, and the other is a hole for accommodating the elbow fitting, hereinafter also referred to as the inflow hole 114 or pump input hole 114. Any location of the drain hole 112 and the inflow hole 114 is contemplated. Likewise, any number of additional holes is contemplated.

The lower reservoir 104 may be wider than the upper tank 108. The lower reservoir 104 may contain a water pump 116 and associated tubing 118. The lower reservoir 104 not only contains the water for the fountain 100, but along with the base housing 102 provides support to the fountain 100 and helps prevent wobbling of the fountain 100 during operation.

A first end of the tubing 118 is attached to the pump 116. The tubing 118 may be run from the pump 116 up through the support rack 106 and to the base of the upper tank 108. The second end of the tubing 118 is connected to an elbow fitting 120 that protrudes from the inflow hole 114 in the bottom of the upper tank 108. Water pumped up through the tubing 118 exits the elbow fitting 120 into the interior of upper tank 118.

Figure 6:
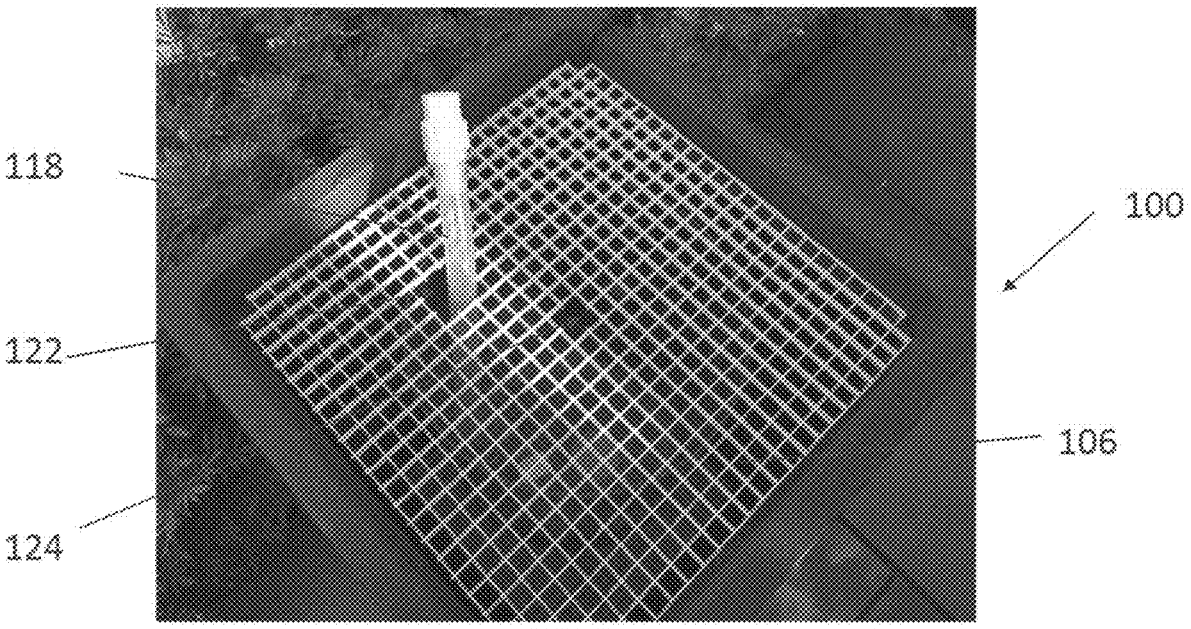
FIG. 6 is a perspective view of the partially disassembled fountain of FIG. 1, showing an exemplary support rack with protruding tubing.
Figure 7:
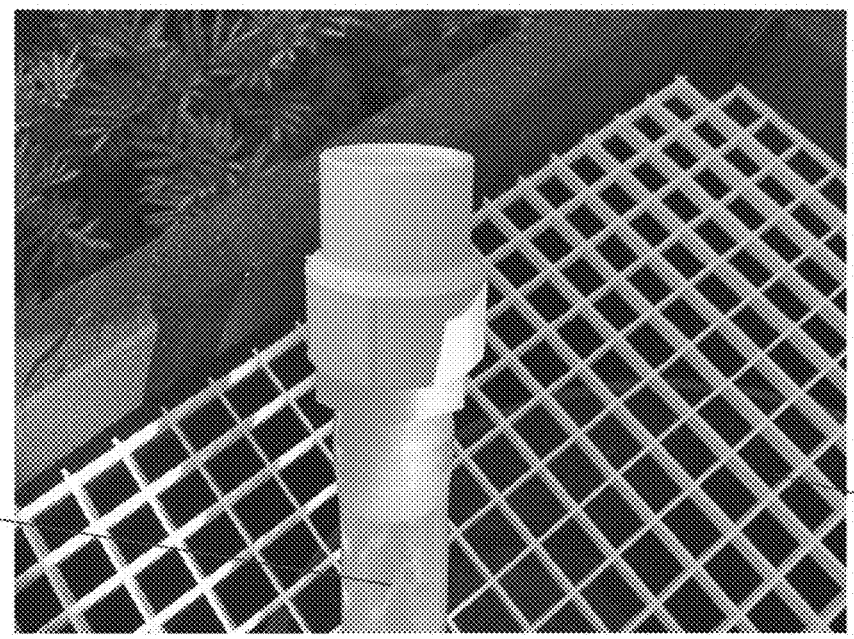
FIG. 7 is a perspective view of the partially disassembled fountain device of FIG. 1, showing the upper end of the exemplary tubing.
Figure 8:
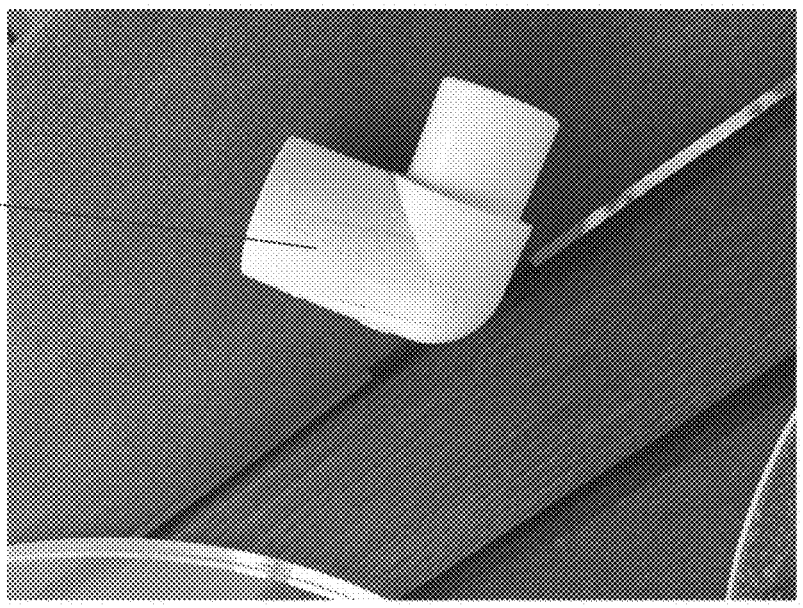
FIG. 8 is a perspective view of an exemplary elbow fitting.
Figure 9:
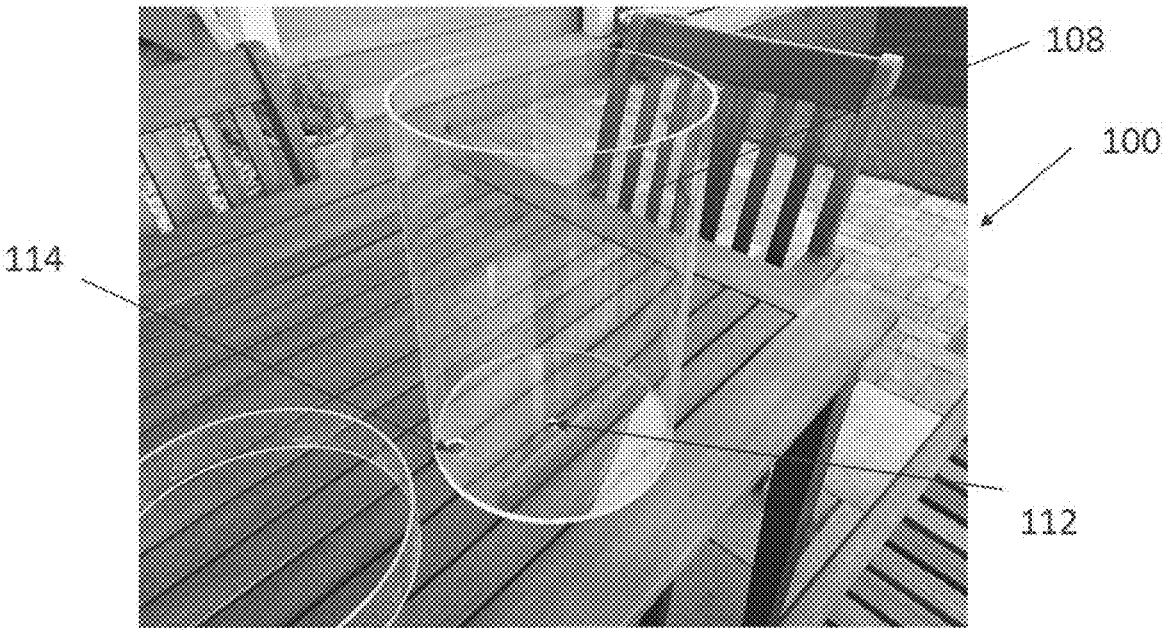
FIG. 9 is a perspective view of the empty upper tank of the device of FIG. 1.
Figure 10:
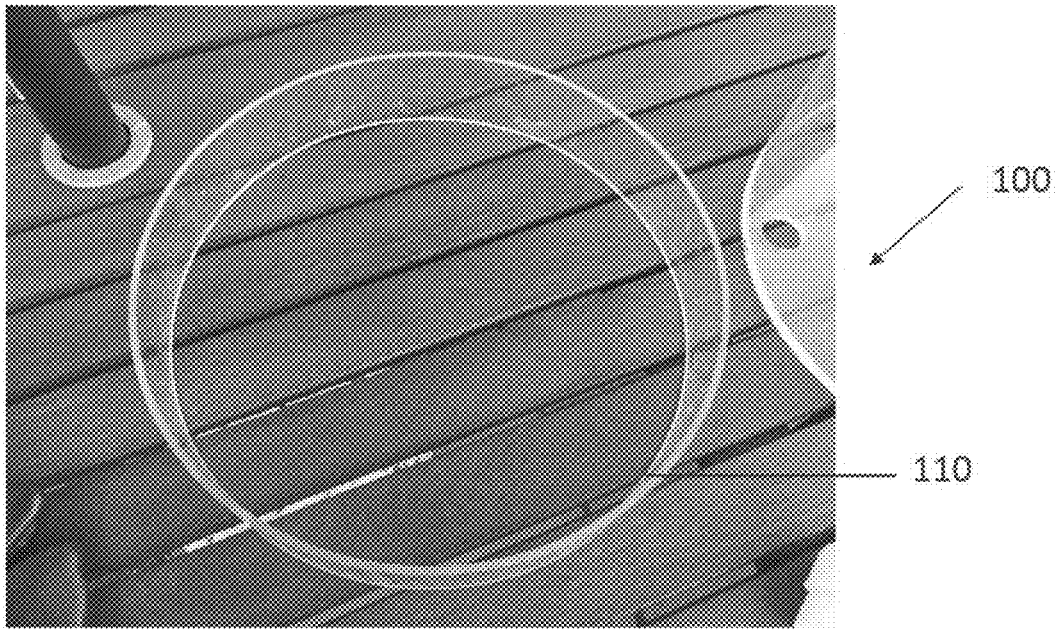
FIG. 10 is a perspective view of the outer ring of the device of FIG. 1.
Figure 11:
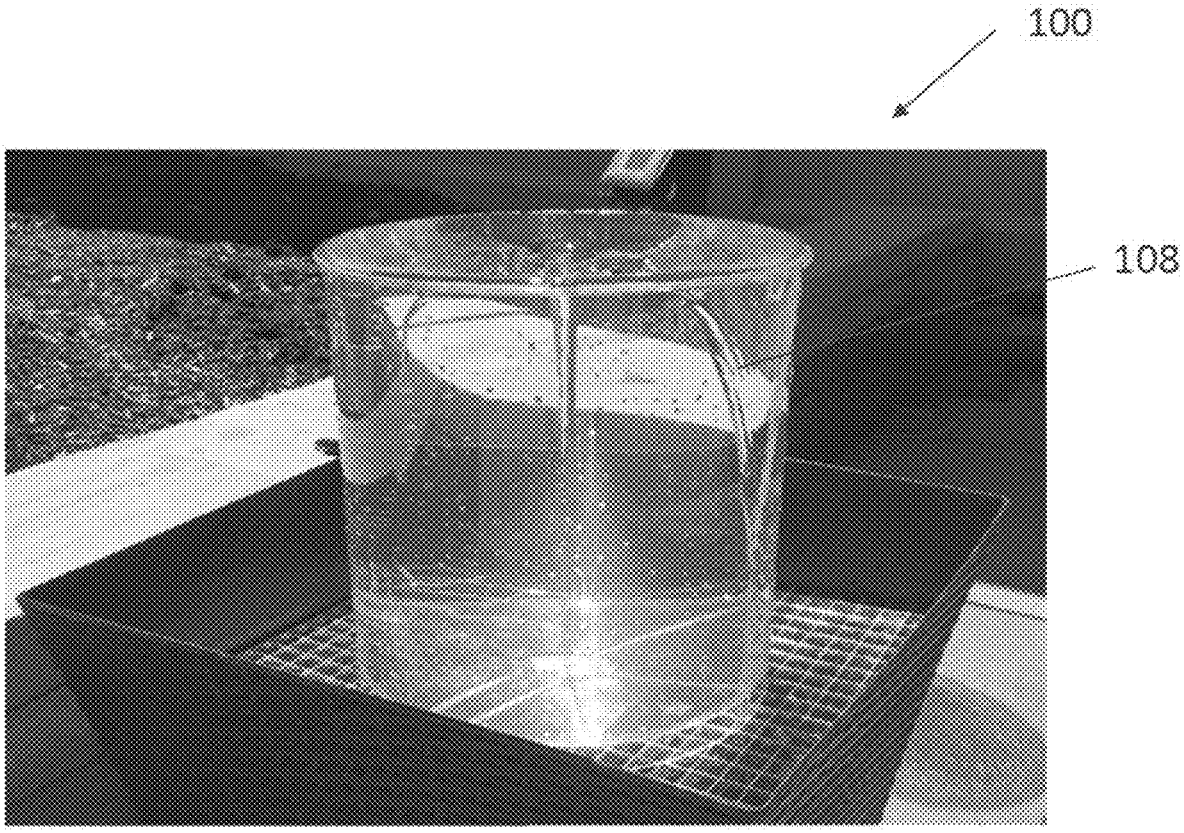
FIG. 11 is a perspective view of the device of the fountain of FIG. 1, with aggregate removed.
Figure 12:
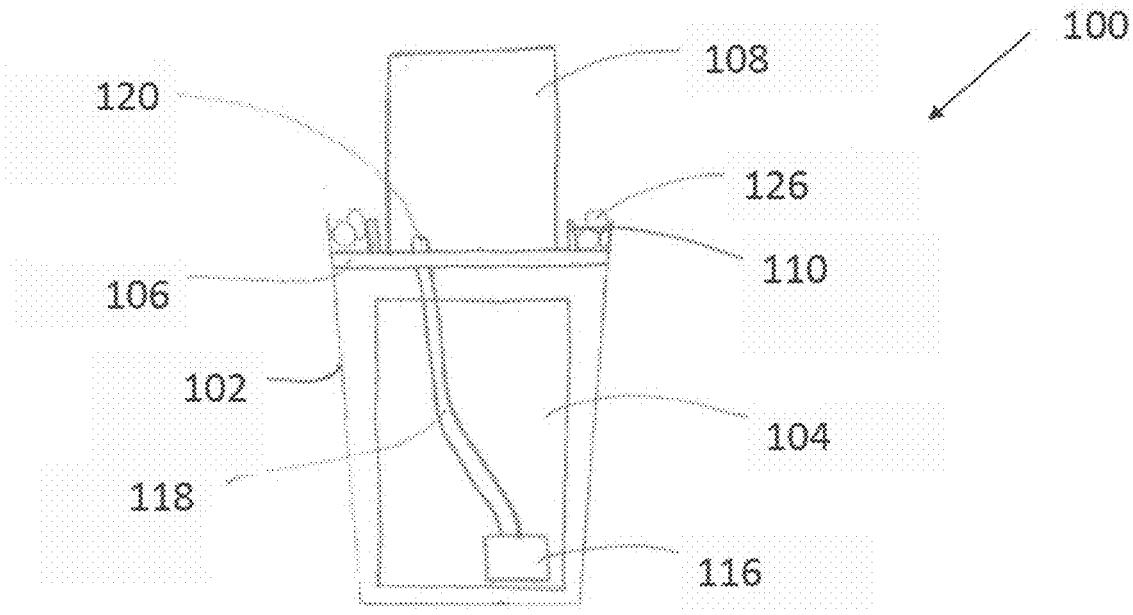
FIG. 12 is an illustration of a cross-sectional side view of the fountain of FIG. 1.

As shown in FIGS. 6 and 7, the support rack 106 may be a plastic egg crate troffer diffuser or other type of egg crate or grid or rack that allows water to pass through to the lower reservoir 104 below. In exemplary embodiments, the lower reservoir 104 may simply be the interior space defined by the base housing 102. In other exemplary embodiments, the lower reservoir 104 may be a separate container. Regardless, the support rack 106 may be wedged into the base housing 102 or it may rest upon supports. In some embodiments, the support rack 106 is removable to allow for access to the lower reservoir 104 from the top of the fountain 100. The support rack 104 has a first aperture 122 to allow the tubing 118 to pass up to the upper tank 108, and a second aperture 124 to allow water flowing down the drain hole 112 in the upper tank 108 to pass down into the lower reservoir 104. In an exemplary embodiment, the support rack 104 may be comprised of a plastic, metal, wood, or any other material that is capable of supporting the weight of the upper tank 108 when full of water.

Figure 13:
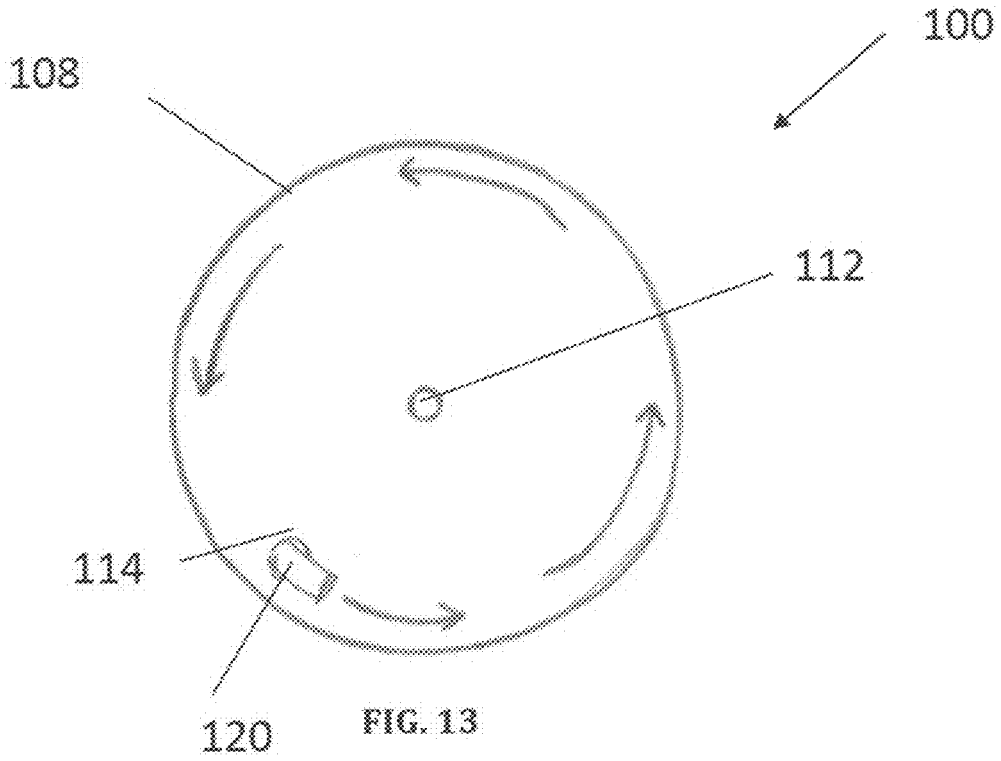
FIG. 13 is a top plan view of the device of FIG. 1, illustrating the flow direction of water in the upper tank during operation.

An illustration of the directional flow of water leaving the elbow fitting 120 is shown in FIG. 13. This causes water entering the cylindrical upper tank 108 to spin around the vertical axis of the upper tank 108 and induces a vortex in the middle of the tank 108. An example of such a vortex can be seen in FIGS. 1, 2, and 11. In other embodiments, different types of nozzles, fittings, valves, etc. may be used to introduce water into the upper tank 108. In some embodiments, there may be two or more locations where water is introduced into the upper tank 108. In some embodiments one fitting/nozzle 120 may induce a vortex while another fitting/nozzle 120 does not, allowing a user to change the fountain 100 settings to either have a vortex fountain 100 or a non-vortex fountain 100. The direction of flow may also be changed as desired. Additionally, different size/shape fittings/nozzles 120 are contemplated to change fountain 100 setting such as to create a different size, shape, or speed vortex or a non-vortex fountain 100.

As shown in FIG. 1, the base housing 102 of the fountain 100 may look like a planter or otherwise be designed to fit in with a patio or outdoor landscape. In the embodiment of FIG. 1, rock aggregate 126 are positioned around the outer ring 110 to help disguise the support rack 106 and otherwise provide an aesthetically pleasing design. In other embodiments, other types of materials may be used to surround the outer ring 110 and hide the support rack 106 and view to the lower reservoir 104 below. In some embodiments fixtures may be inserted to allow for plants to be positioned around the outer ring 110. Lights may also be placed around the outer ring 110.

A user may operate an exemplary embodiment of the fountain device 100 by filling the lower reservoir 104 with water and turning on the pump 116. Once the pump 116 is turned on water from the lower reservoir 104 may be pumped through the tubing 118 and out the elbow fitting 120 on the bottom of the upper tank 108. The water rises in the upper tank 108 and a vortex is induced. Water that rises to the top of the upper tank 108 may be permitted to spill over the sides of the tank, providing a secondary visual to the vortex itself. Water that spills over the sides falls down through the support rack 106 and into the lower reservoir 104. A user may be able to induce or prevent spill-over as desired by manipulating the pump 116 flow rate and the amount of water in the lower reservoir 104.

In some embodiments, the lower reservoir 104 and surrounding area in the base housing 106 may both be filled with water, and the lower reservoir 104 may have one or more apertures in its surface to allow water within the base housing 106 to enter and exit. This may help conserve water when water flowing over the top of the upper tank 108 does not fall straight down into the lower reservoir 104. It may also allow a user to utilize rain water that has collected inside the base housing, if desirable.

In an exemplary embodiment, the pump 116 is a SL-4000 Submersible Pump that runs 1057 GPH, the tubing 118 is ¾ inch, the upper tank 108 has a height of 9 3/16" and a width of 9 9/16", the lower reservoir 104 has a comparatively larger height and width. One of ordinary skill in the art will recognize that these are merely exemplary and are not intended to be limiting. Further, that various embodiments the size and dimensions may be changed as desired without departing from the inventive concept. In various embodiments, the fountain device 100 may be sized as desirable to enjoy in various outdoor and indoor settings. For example, in an exemplary embodiment the fountain device 100 has small enough dimensions that it can be placed on a desktop. In another embodiment, the fountain device 100 may be large enough to make it the focal point of a garden. One of ordinary skill in the art will recognize that as the size of the fountain device 100 is altered the proportion of water inflow to outflow, pump 116 size and power, reservoir 104 size, and the size of other related components, may need to be altered as necessary to maintain the vortex feature. In some exemplary embodiments, including those shown in FIGS. 1 through 42*c*, the fountain 100 is portable to and from various locations. The weight of the fountain 100 is preferably such that it can be moved by one or two people using manual force. Such exemplary embodiments permit for the same fountain 100 to be utilized in a variety of locations about a home or business, etc.

In an exemplary embodiment the upper tank 108, lower reservoir 104, and aggregate shield are made of acrylic, which is clear and allows viewers to see the vortex. However, in other embodiments different components of the fountain device 100 may be made of a variety of different materials as desired. For example, without limitation, they may be made of glass or PVC.

In an exemplary embodiment, the fountain device 100 includes a water-level indicator. In another exemplary embodiment, the fountain device 100 includes lighting underneath the upper tank 108 or in other locations in order to make the fountain aesthetically pleasing even after dark. In some embodiments, the base housing 102 may have a removable panel or door that allows maintenance access to the lower reservoir 104.

Figure 14:
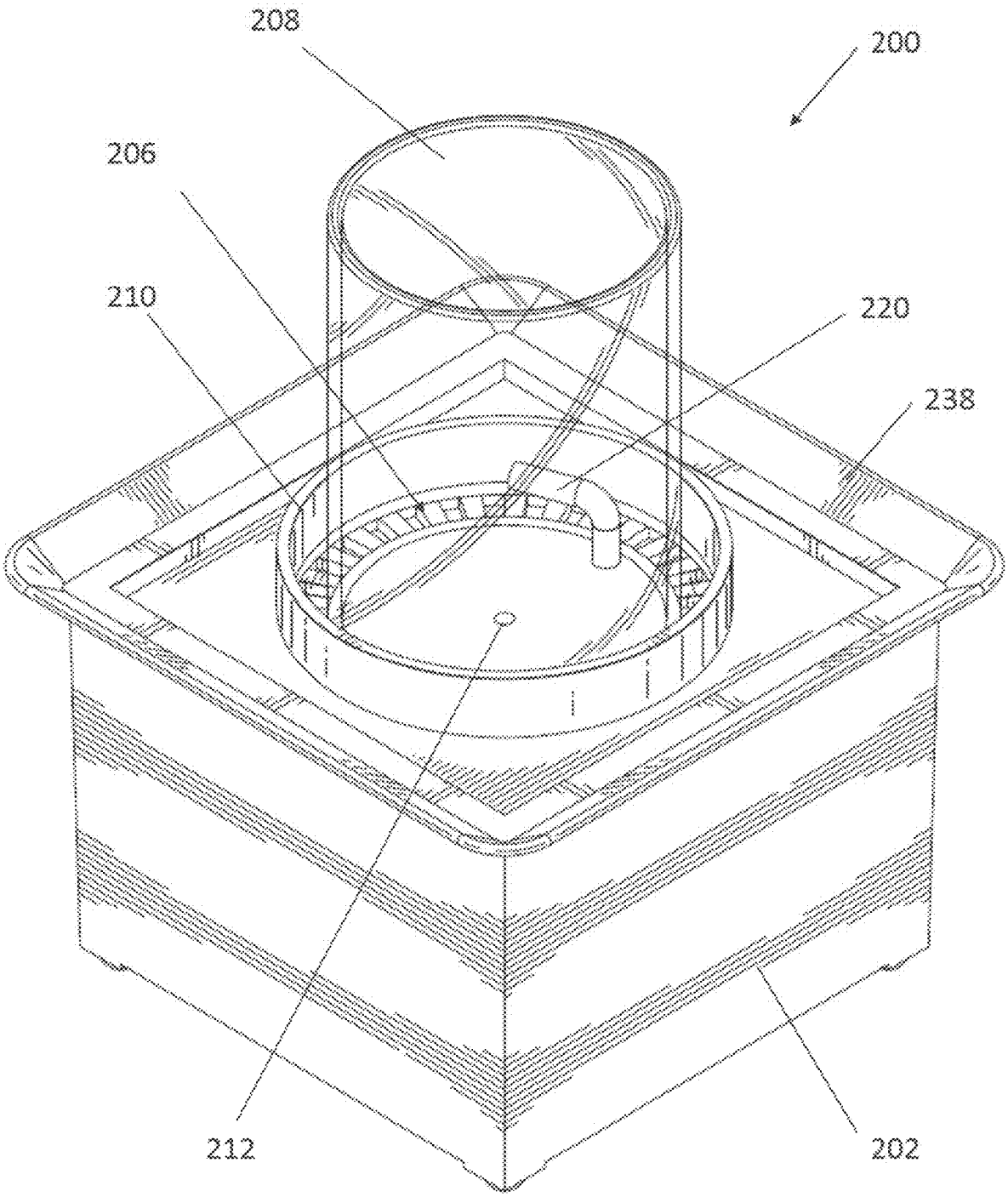
FIG. 14 is a perspective view of another exemplary fountain.
Figure 15:
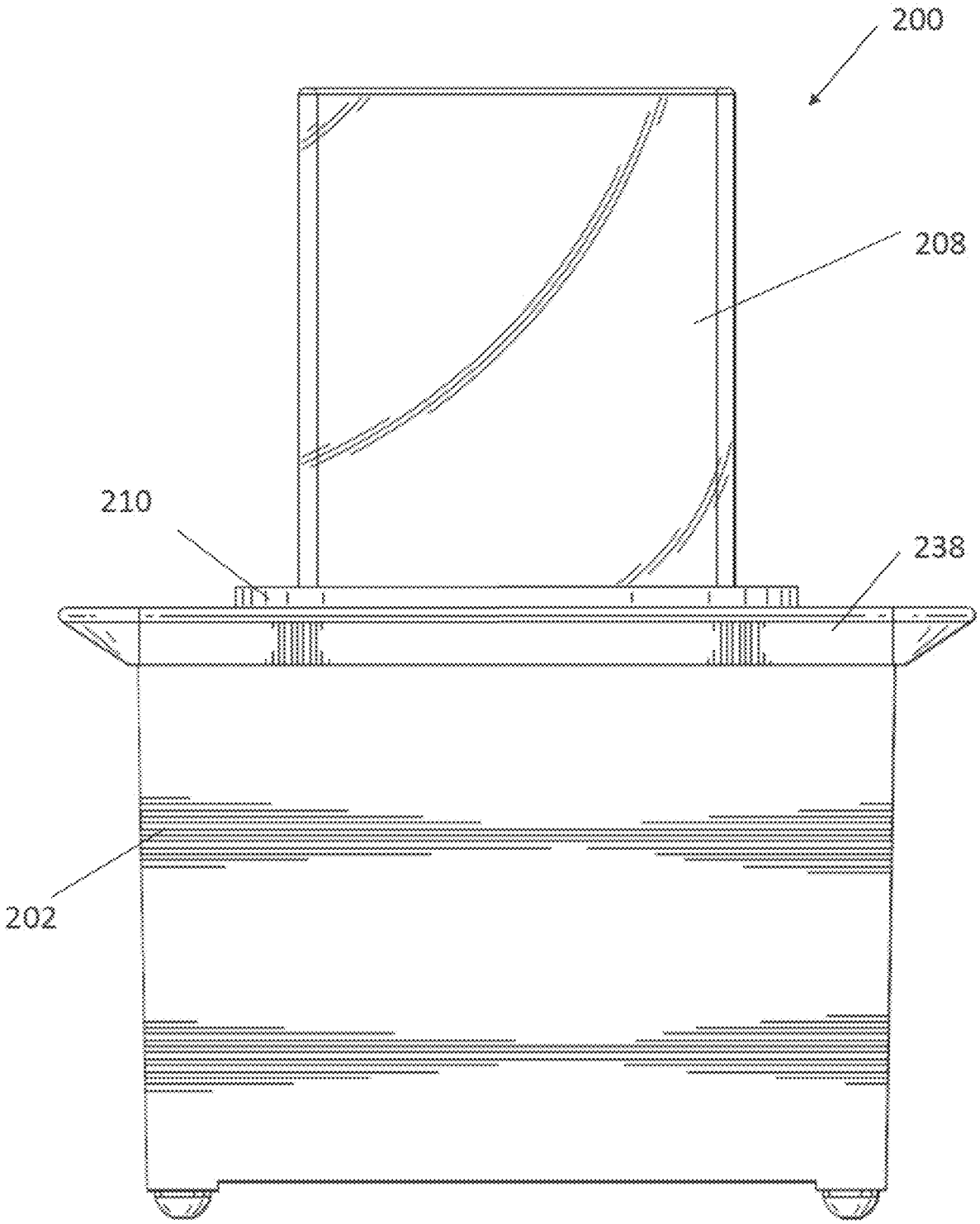
FIG. 15 is a front elevation view of the exemplary fountain of FIG. 14.
Figure 16:
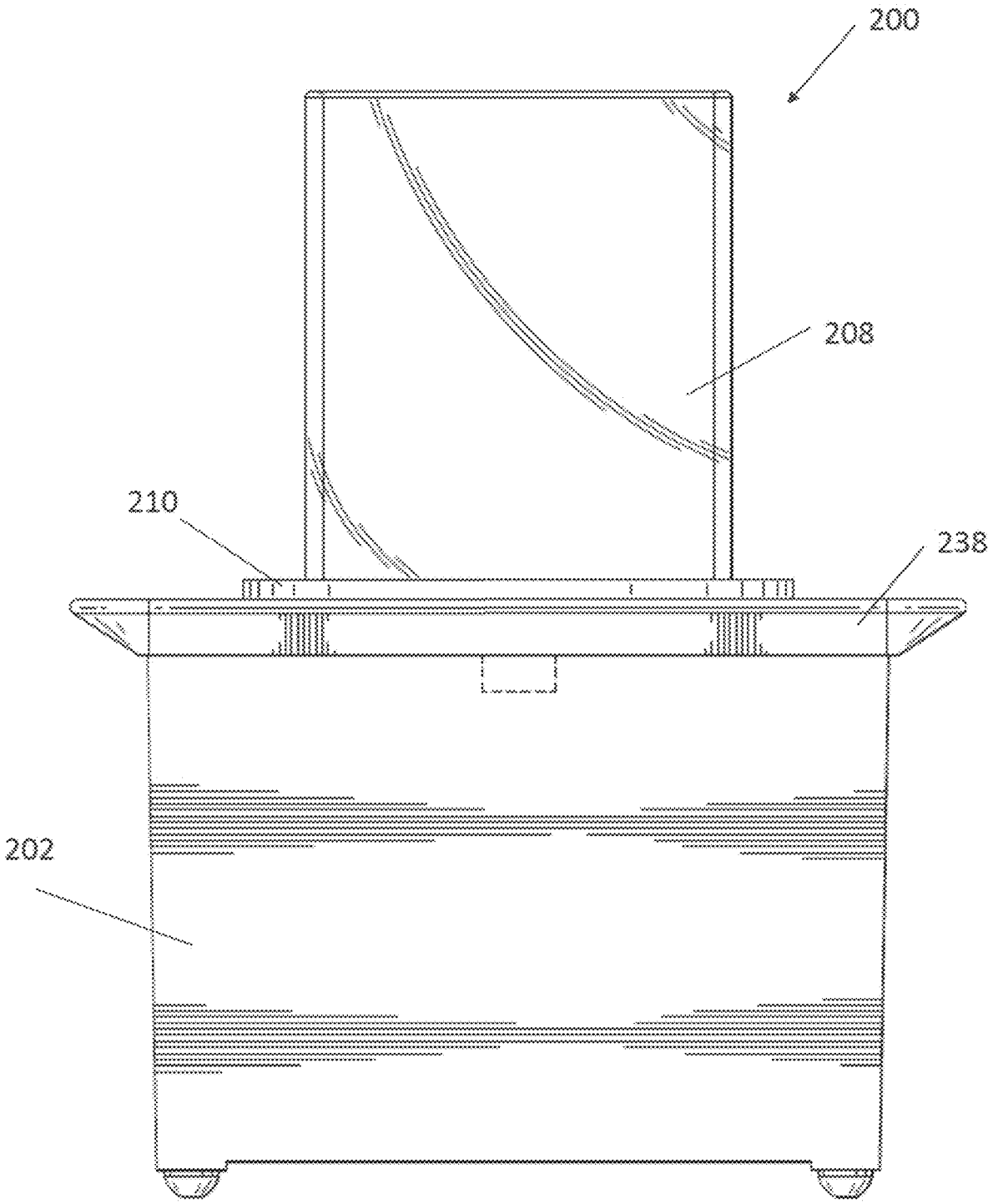
FIG. 16 is a rear elevation view of the FIG. 14 embodiment.
Figure 17:
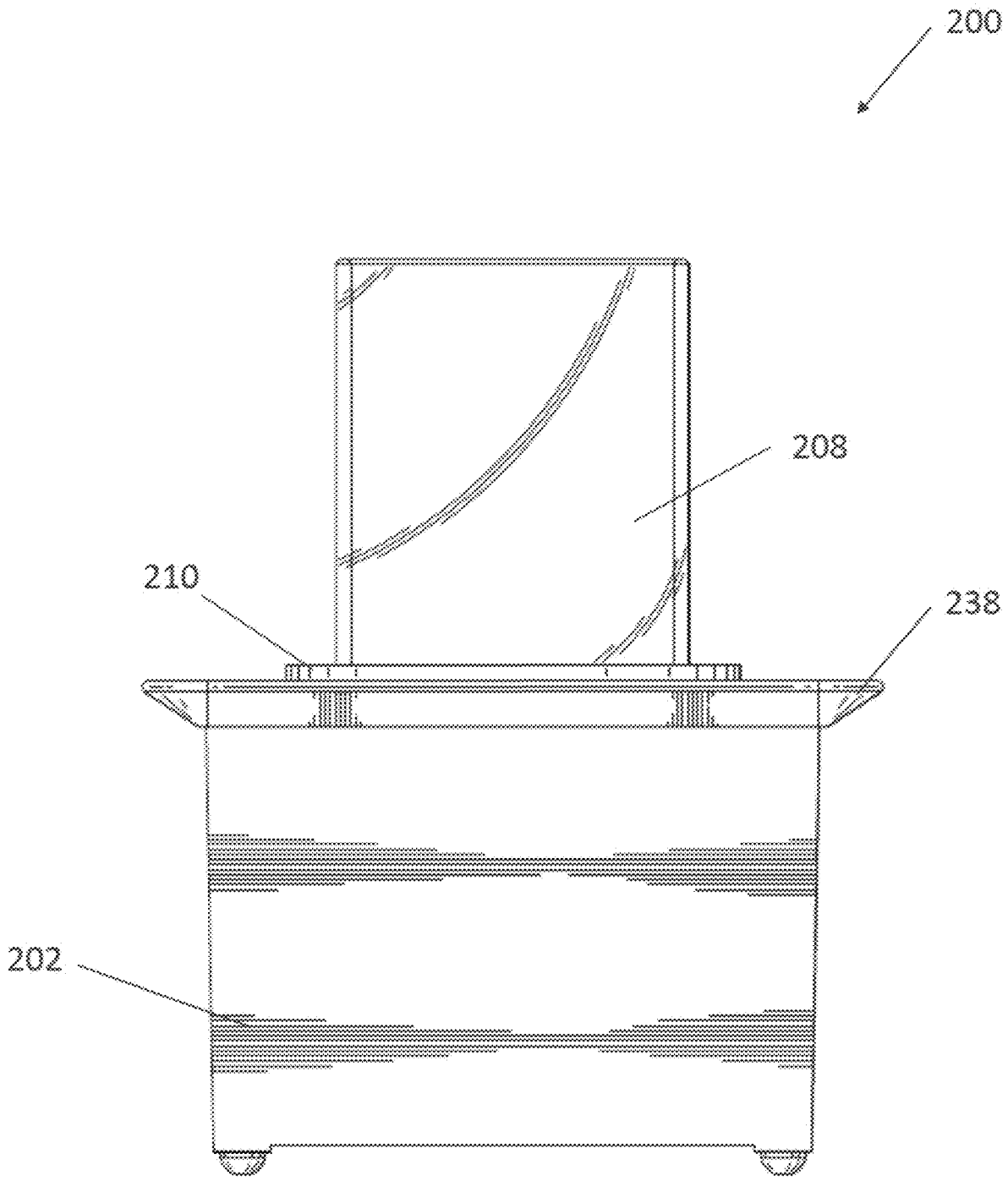
FIG. 17 is a right side view of the FIG. 14 embodiment.
Figure 18:
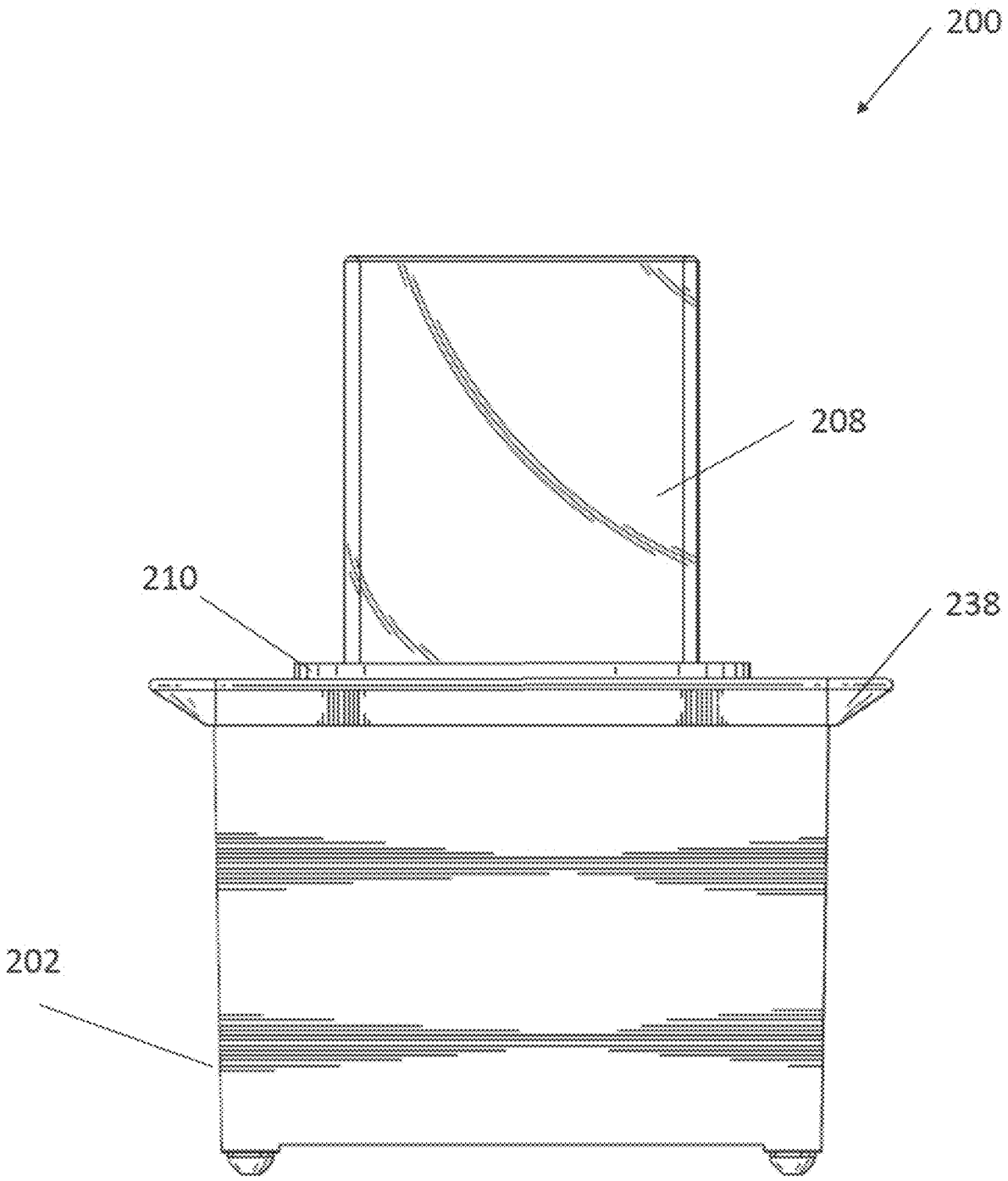
FIG. 18 is a left side view of the FIG. 14 embodiment.
Figure 19:
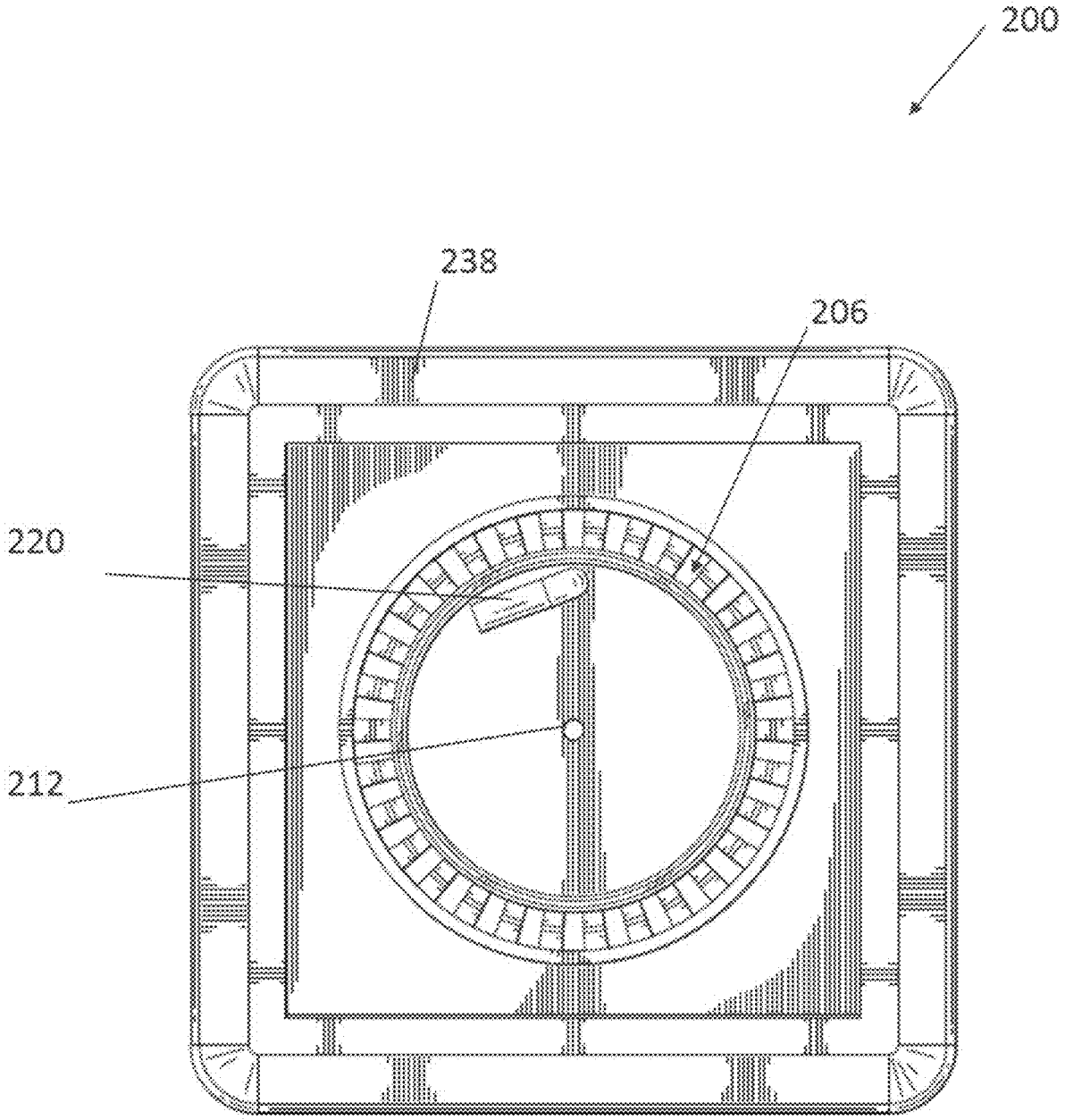
FIG. 19 is a top plan view of the FIG. 14 embodiment.
Figure 20:
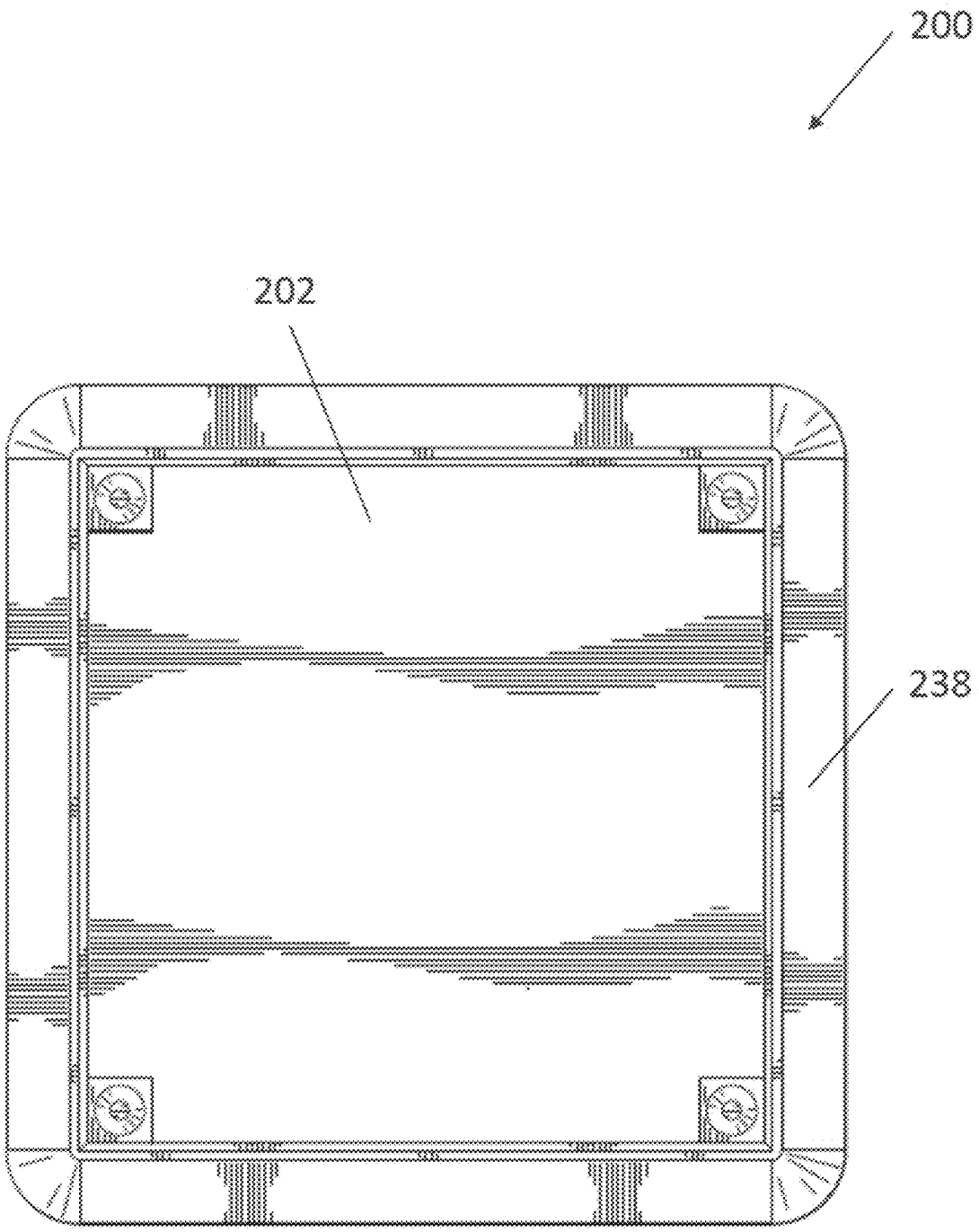
FIG. 20 is a bottom plan view of the FIG. 14 embodiment.
Figure 21:
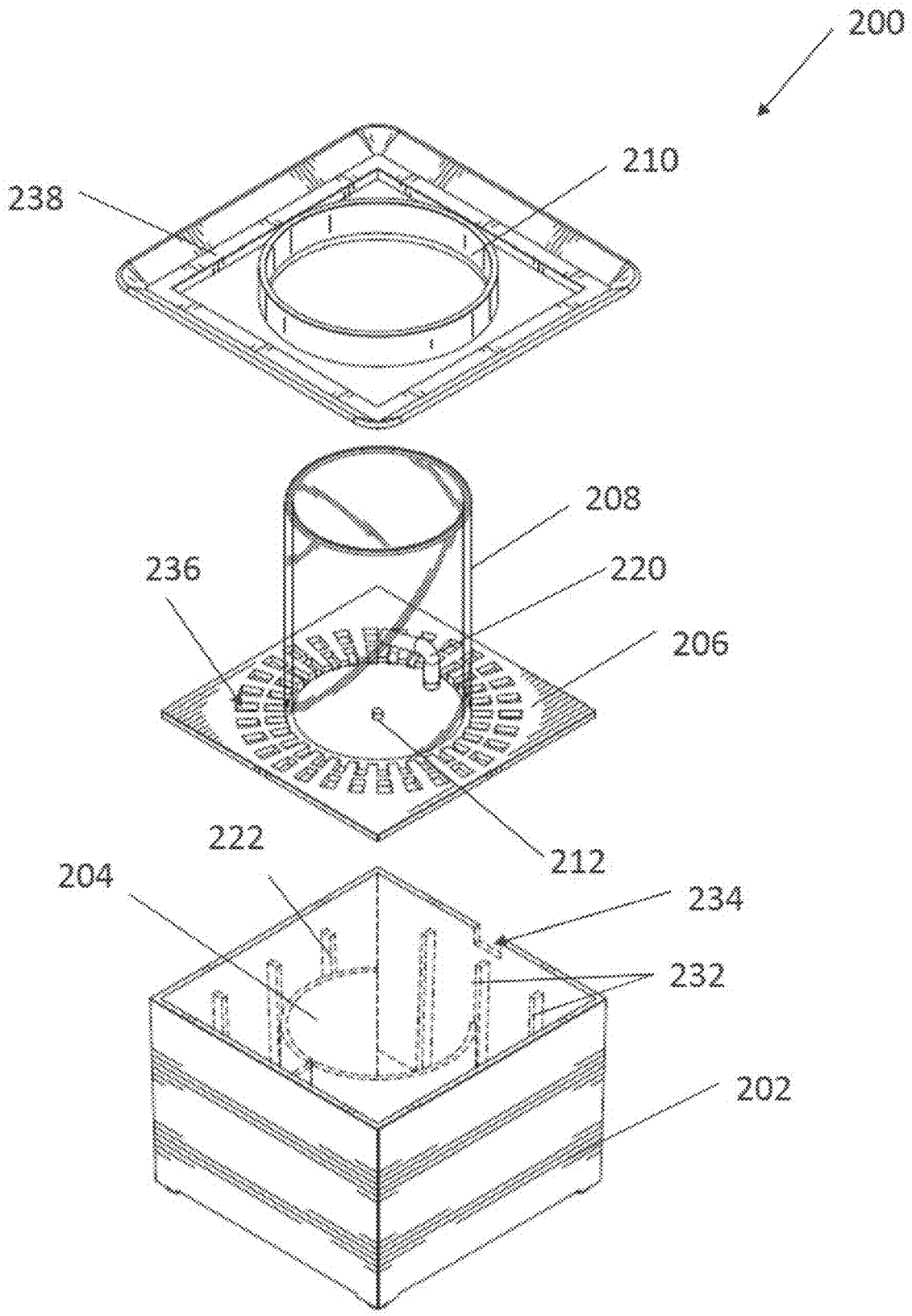
FIG. 21 is an exploded perspective view of the FIG. 14 embodiment.
Figure 22:
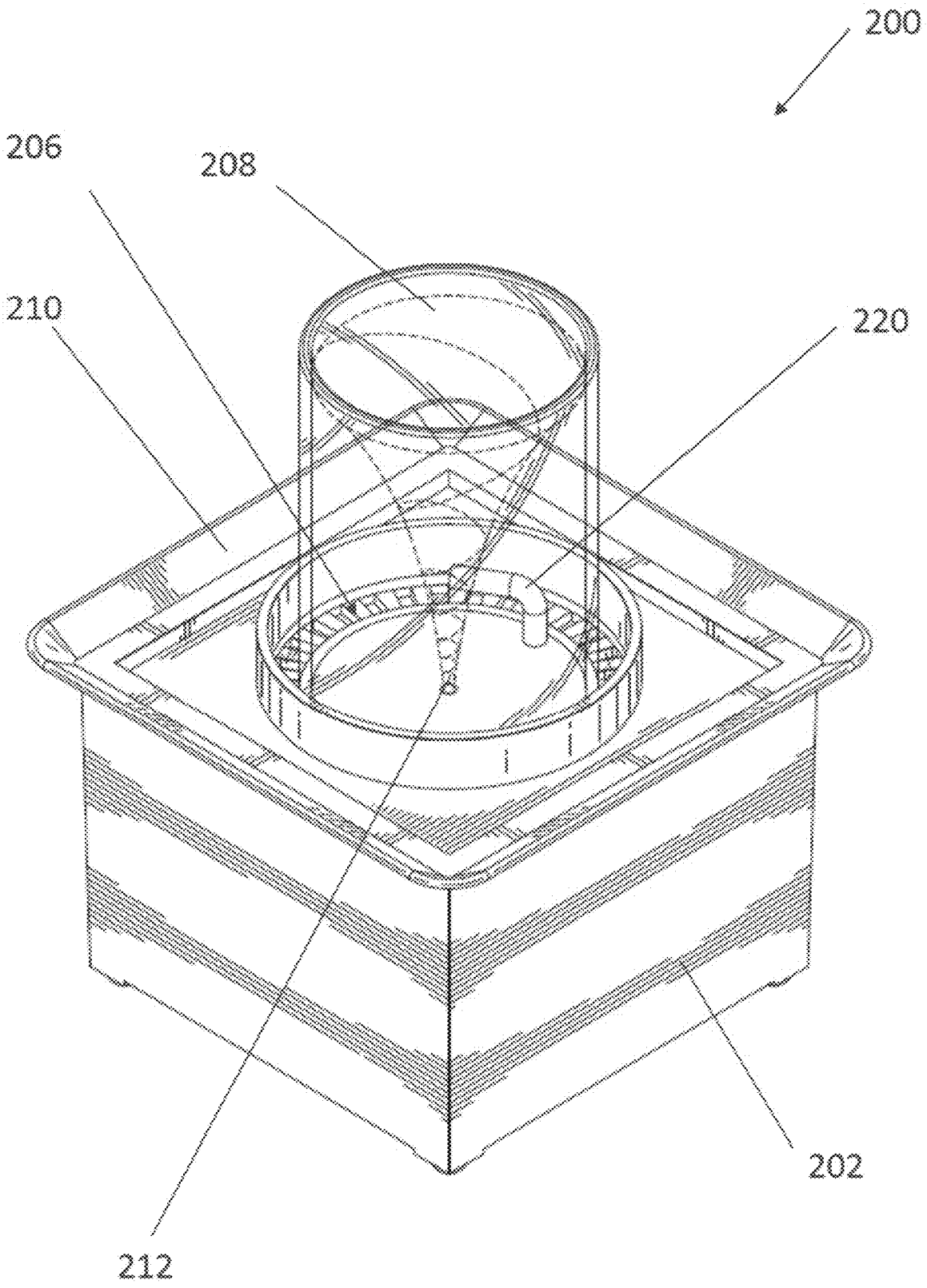
FIG. 22 is an environmental perspective view of the FIG. 14 embodiment.

FIG. 14 though FIG. 22 illustrates another exemplary embodiment of the fountain 200. Please note that similar components have been numbered similarly, but increased by 100 (i.e., 102 to 202). In this embodiment, the base housing 202 may be substantially square (though any shape is contemplated) and may comprise a lower reservoir 204. In other exemplary embodiments, the base housing 202 may serve as the lower reservoir 204 or the two may be integrally formed. Regardless, the lower reservoir 204 may comprise a C-shaped partial cylinder portion which may be open on the top thereof. The lower reservoir 204 may be configured to receive water for creating the fountain 200 as well as recycled water drained from the upper cylinder 208 or other portion of the fountain 200. As such, the lower reservoir 204 and/or the base housing 202 may be substantially water tight on the bottom and sides thereof. A number of stiffeners 232 may extend vertically along an inner surface of the base housing 202 to stiffen the base housing 202 and the fountain 200. The lower reservoir 204, the base housing 202, and the stiffeners 232 may be configured to support the cylindrical upper tank 208 by allowing a support plate 206 to rest on the upper surface thereof. As will be explained in greater detail herein, the support plate 206 may secure the cylindrical upper tank 208.

The base housing 202 may further comprise a depression 234 located on an upper edge of one side thereof configured to permit an electrical cord 428 to extend from the lower reservoir 204 outside of the base housing 202 to be plugged in, in other exemplary embodiments, an aperture may be used in lieu of the depression 234 and may be located anywhere on the base housing 202.

The cylindrical upper tank 208 may be attached, bonded, or integrally formed with the support plate 206. The support plate 206 may be comprised of metal or plastic though any material is contemplated. The support plate 206 may comprise a series of apertures 236 located around the cylindrical upper tank 208. The apertures 236 may allow water to drain into the lower reservoir 204. Such water may include, without limitation, rain water, overflow water, or water deliberately poured over the apertures 236 to fill the lower reservoir 204. Regardless, an inflow hole 214 may be located in the cylindrical upper tank 208 near the inner wall thereof. The inflow hole 214 may be configured to receive an elbow fitting 220. The elbow fitting 220 may be configured to receive water pumped from a pump 216 located in the lower reservoir 204 via a tube 218. The tube 218 may travel through a first aperture 212 located in the support plate 206 to reach the elbow fitting 220. The elbow fitting 220 may be positioned and oriented to eject the water in a clockwise or counterclockwise direction near the wall of the cylindrical upper tank 208. The ejected water may swirl around the cylindrical upper tank 208 until eventually descending and draining through a drain hole 212 located in substantially the center of the cylindrical upper tank 208, thus creating the vortex. The vortex may be continually drained through the drain hole 212 and new water may be continually pumped through the elbow fitting 220 so as to sustain the vortex.

A tray 238 may be configured to fit atop of the support plate 206. The tray 238 may comprise a center ring 210 which is configured to partially surround the cylindrical upper tank 208 so as to provide an aesthetically pleasing appearance and enhance the stability of the fountain 200. In exemplary embodiments, the center ring 210 may be of sufficient height so as to hide the elbow fitting 220 from ordinary view. The tray 238 may comprise an outer lip which angles upwardly. The tray 238 and the upper lip may be configured to permit rocks or other decorative objects 126 to be securely stored on said tray 238.

Figure 23:
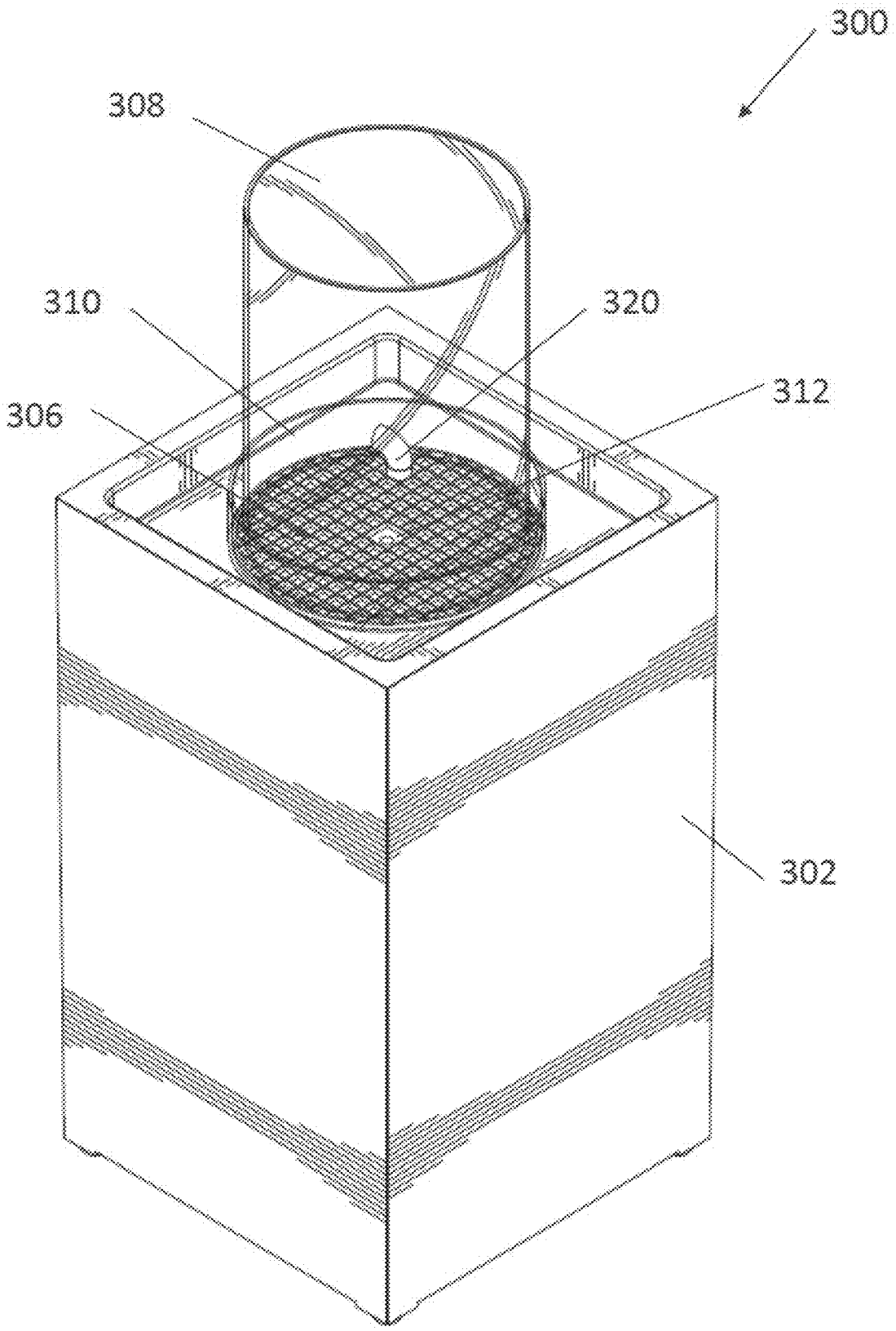
FIG. 23 is a front perspective view of another exemplary fountain.
Figure 24:
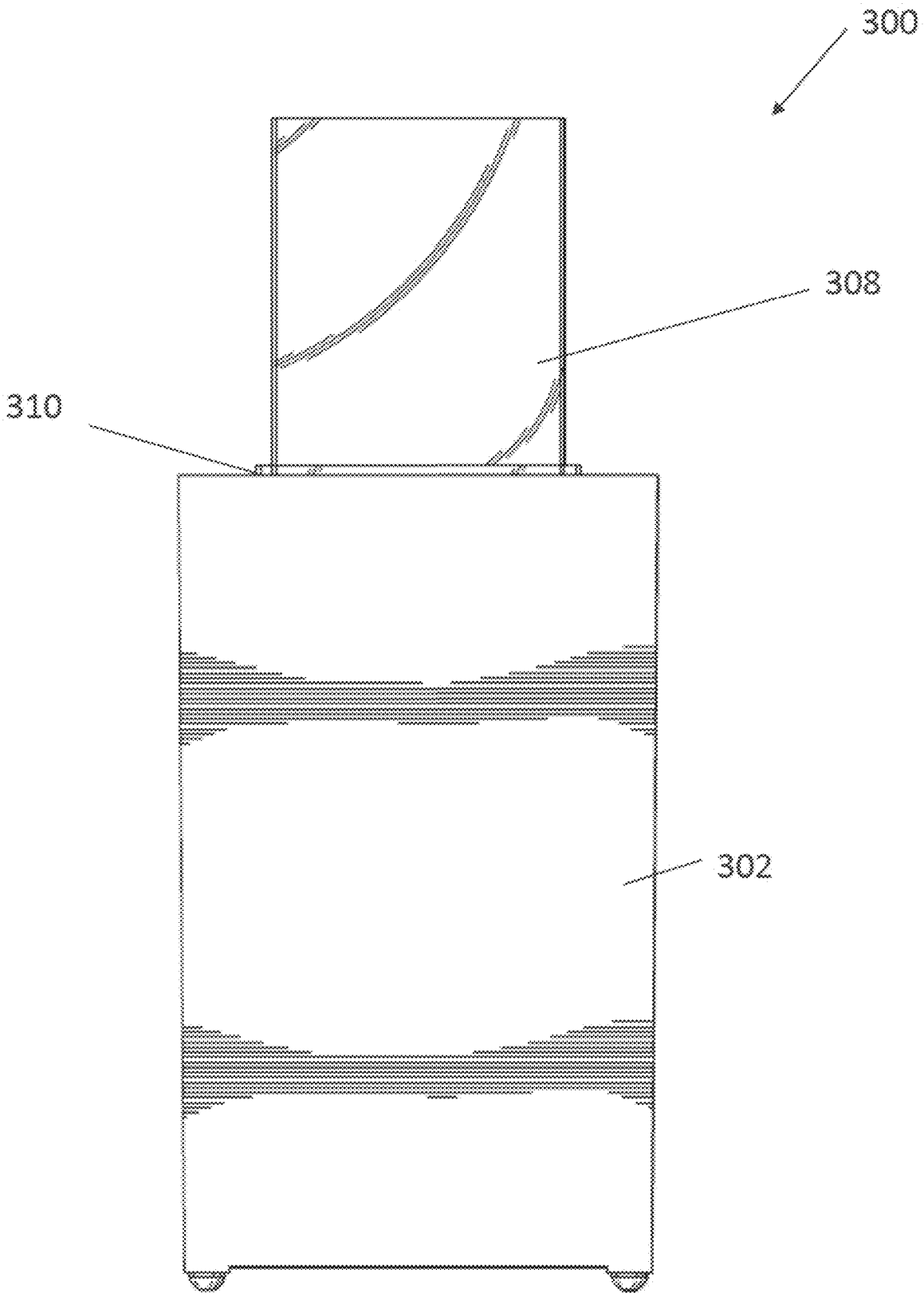
FIG. 24 is a front elevation view of the exemplary fountain of FIG. 23.
Figure 25:
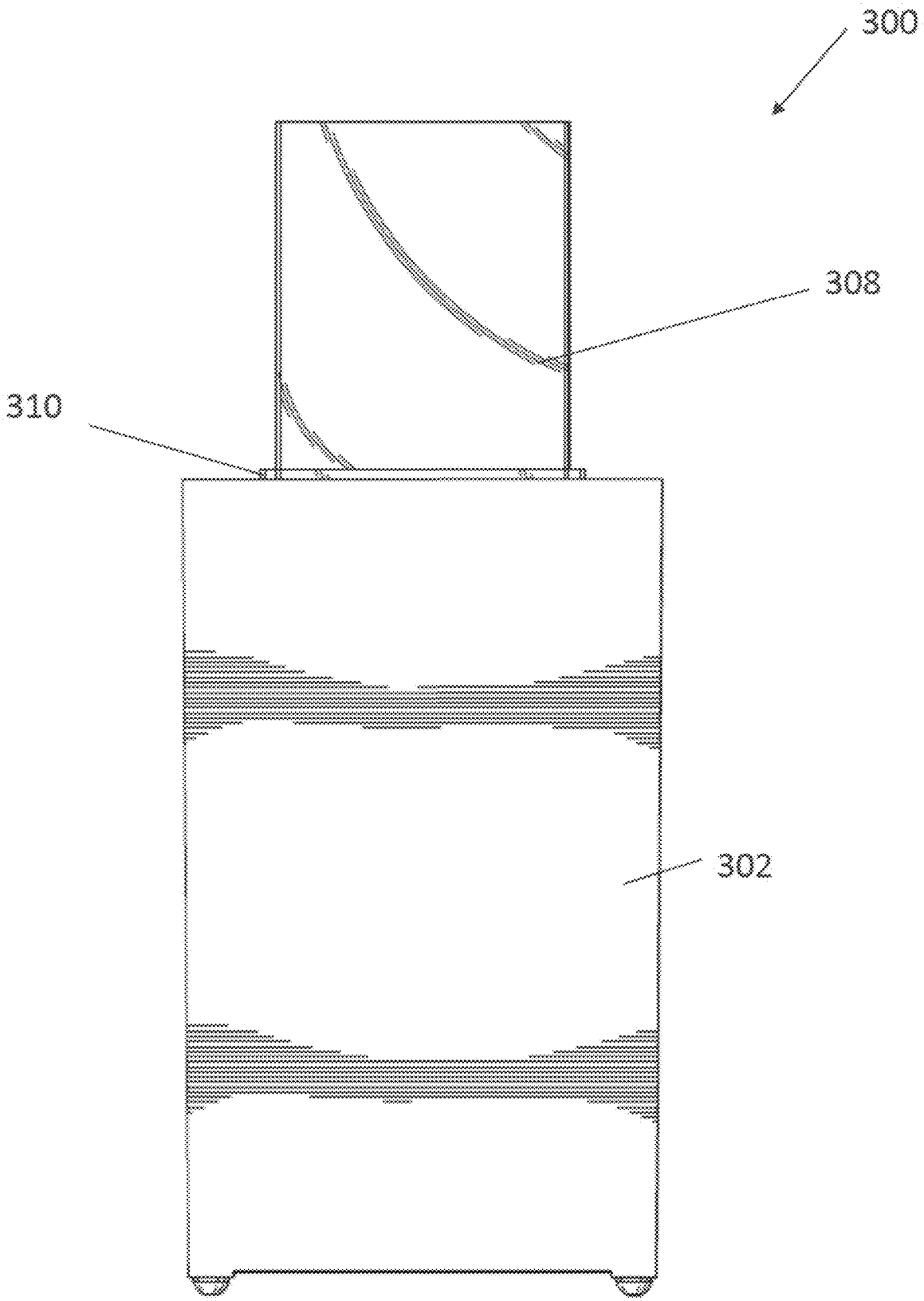
FIG. 25 is a rear elevation view of the FIG. 23 embodiment.
Figure 26:
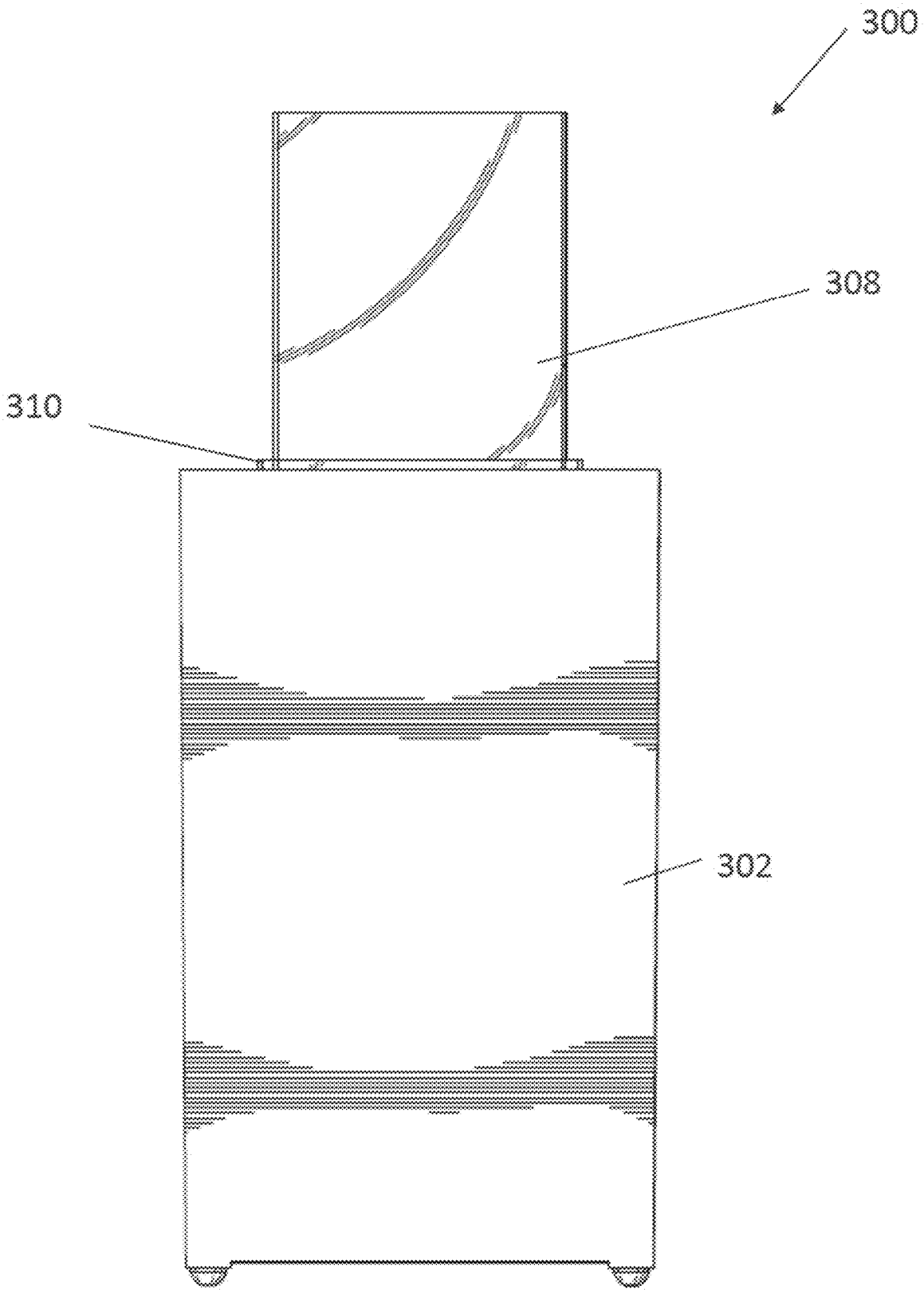
FIG. 26 is a right side view of the FIG. 23 embodiment.
Figure 27:
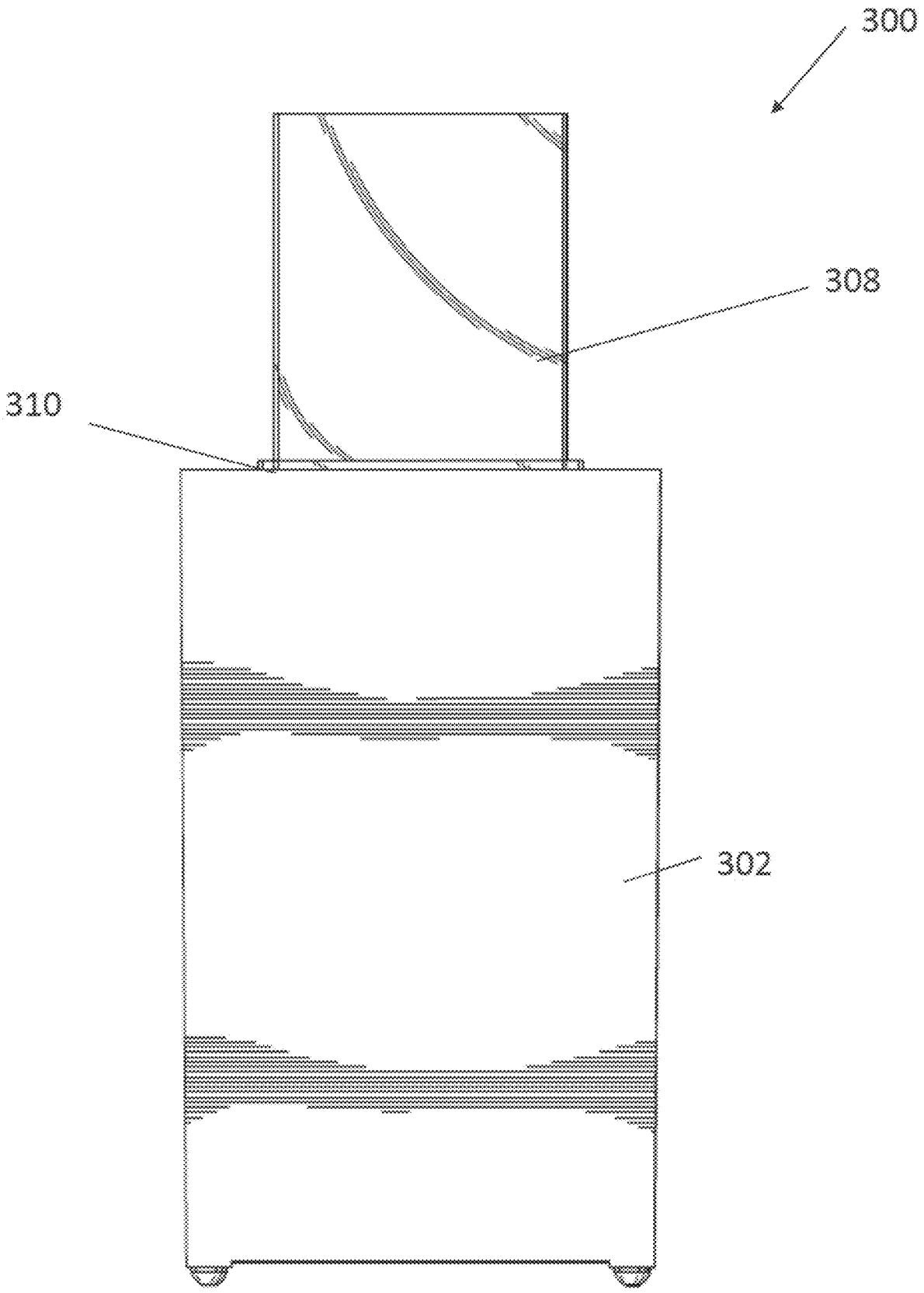
FIG. 27 is a left side view of the FIG. 23 embodiment.
Figure 28:
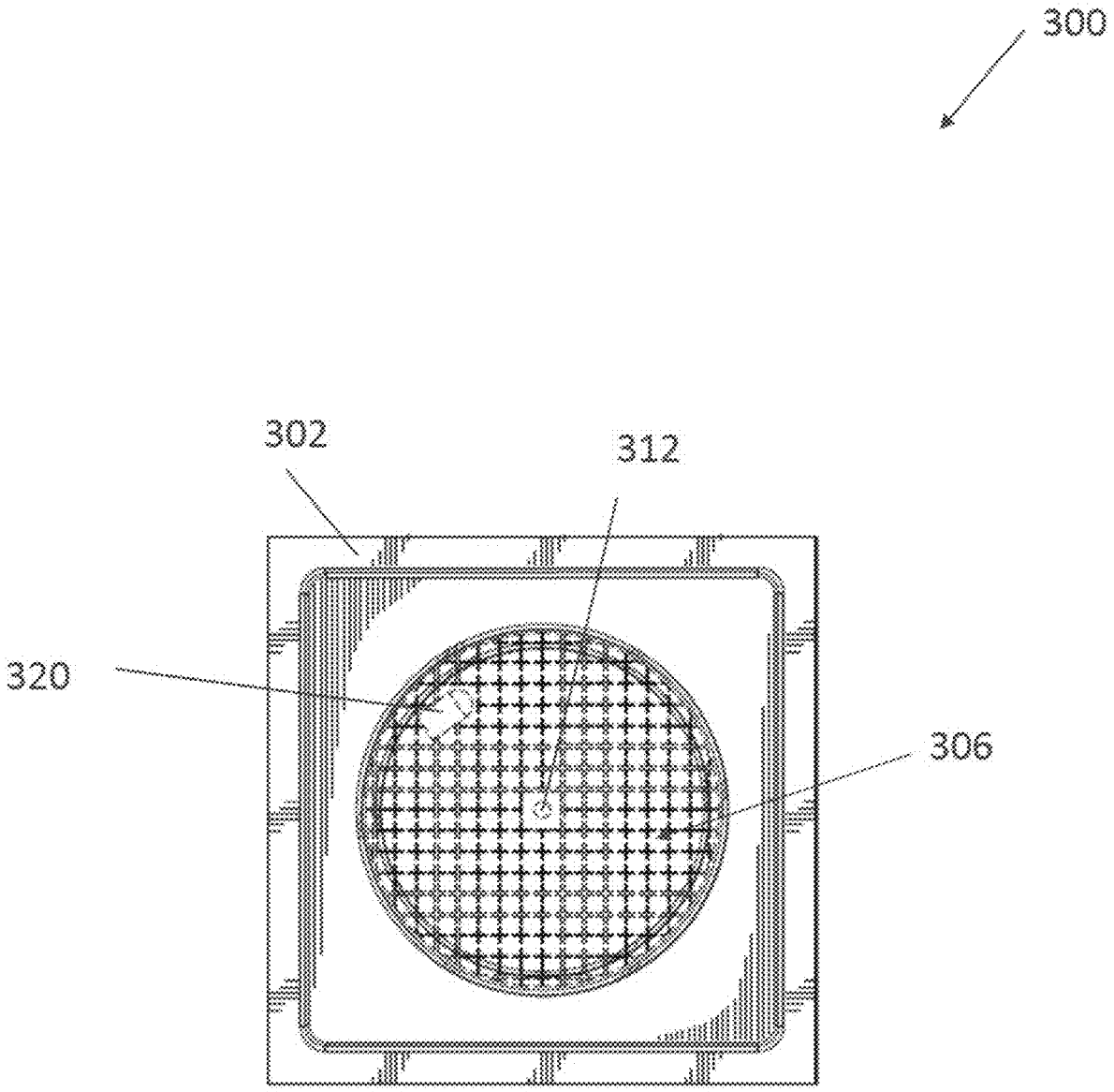
FIG. 28 is a top plan view of the FIG. 23 embodiment.
Figure 29:
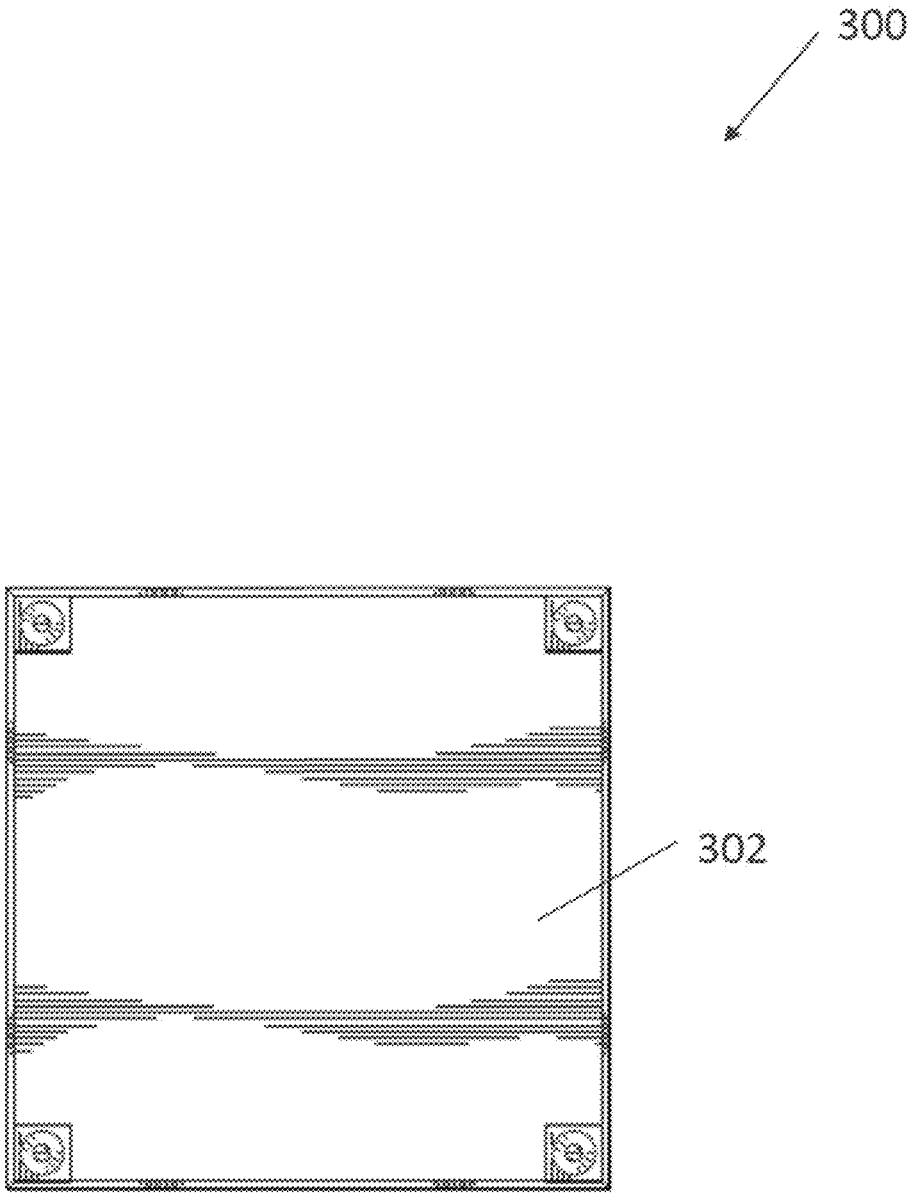
FIG. 29 is a bottom plan view of the FIG. 23 embodiment.
Figure 30:
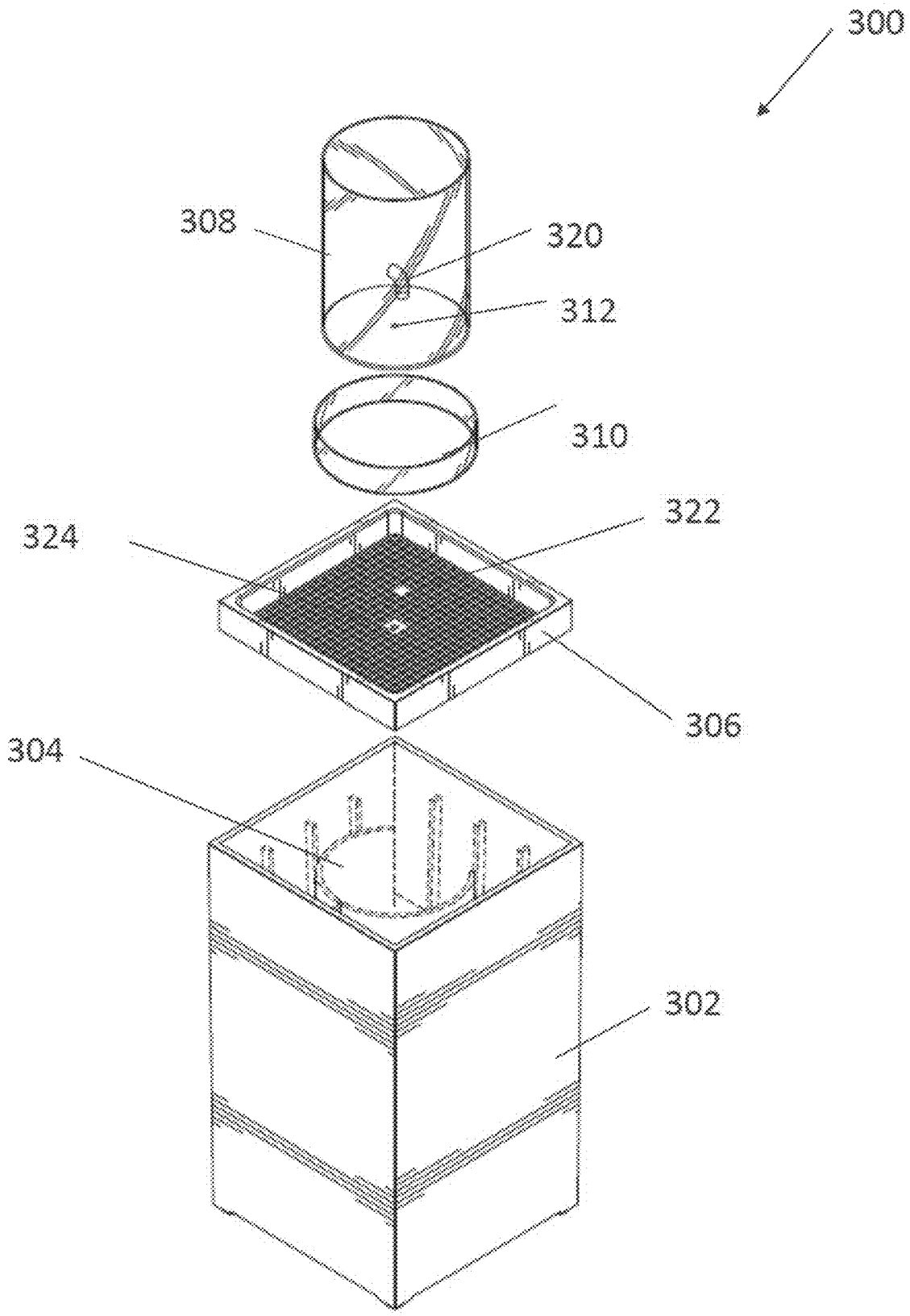
FIG. 30 is an exploded perspective view of the FIG. 23 embodiment.
Figure 31:
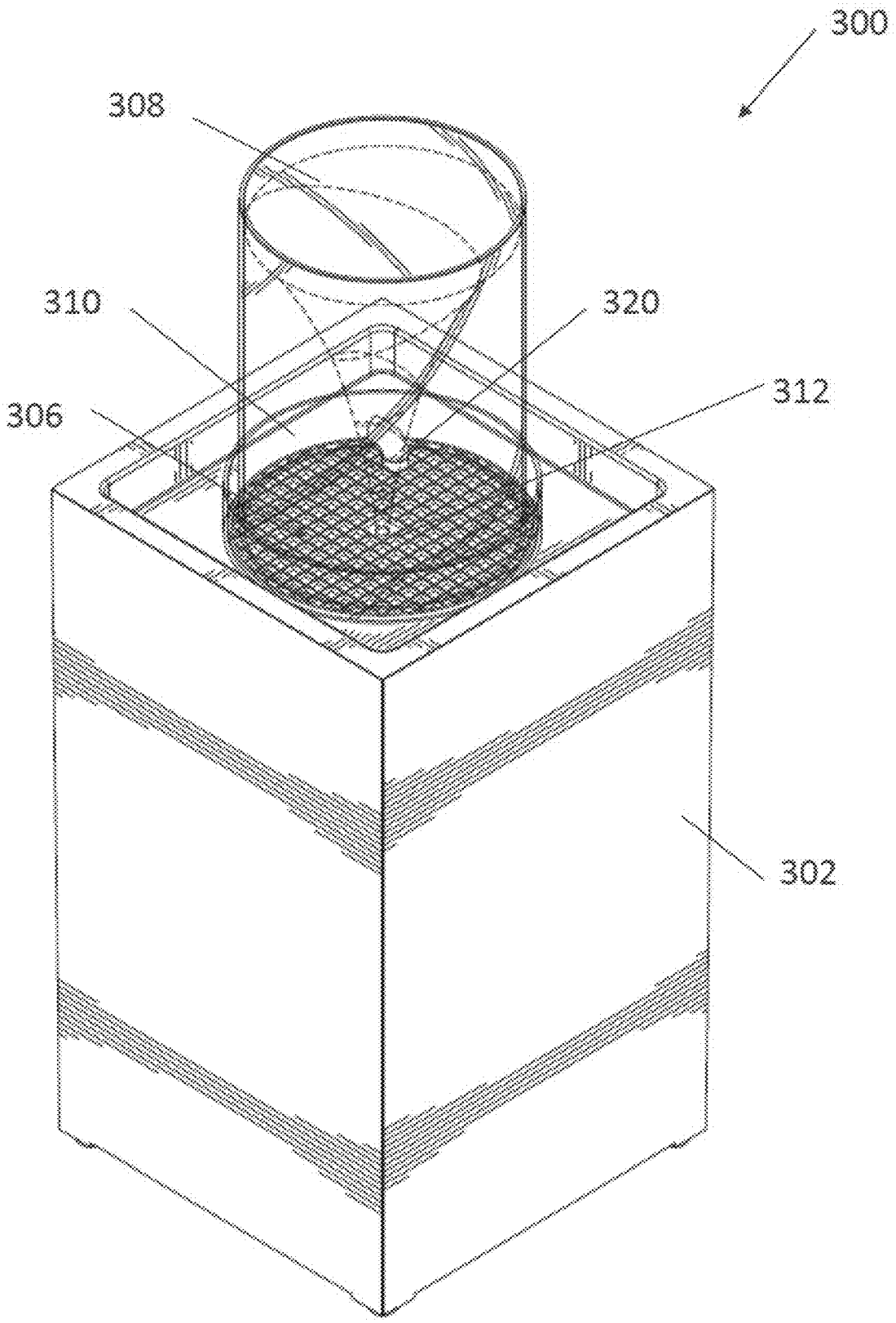
FIG. 31 is an environmental perspective view of the FIG. 23 embodiment.

FIG. 23 though FIG. 31 illustrates another exemplary embodiment similar to the embodiment shown and described with respect to FIG. 14-FIG. 22. Please note that similar components have been numbered similarly, but increased by 100 (i.e., 202 to 302). In this embodiment, however, the base housing 302 may be substantially rectangular in shape, though any shape is contemplated. Instead of the support plate 206, a support rack 306 may be used. The support rack 306 may be a grid similar to a plastic egg crate troffer diffuser or other type of egg crate. The support rack 306 may be comprised of metal or plastic, though any material is contemplated. A lip may extend around the perimeter of the support rack 306 to assist in containing water and any rocks or other decorative features 126 placed on top thereof. A ring 310 may be configured to extend around the base of the cylindrical upper tank 308 to provide an aesthetically pleasing appearance as well as enhance the stability of the fountain 300.

Figure 32:
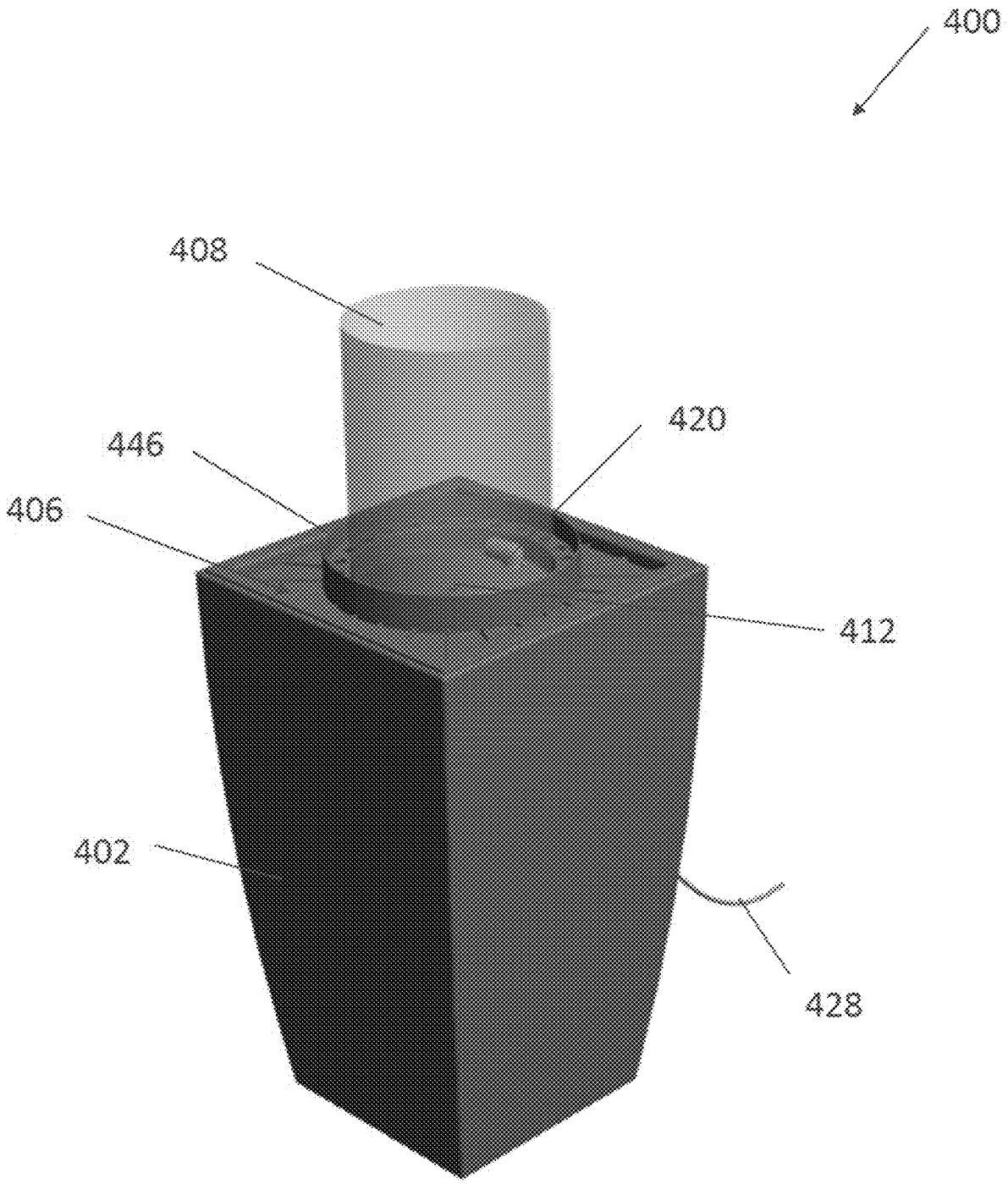
FIG. 32 is a front perspective view of another exemplary fountain.
Figure 33A:
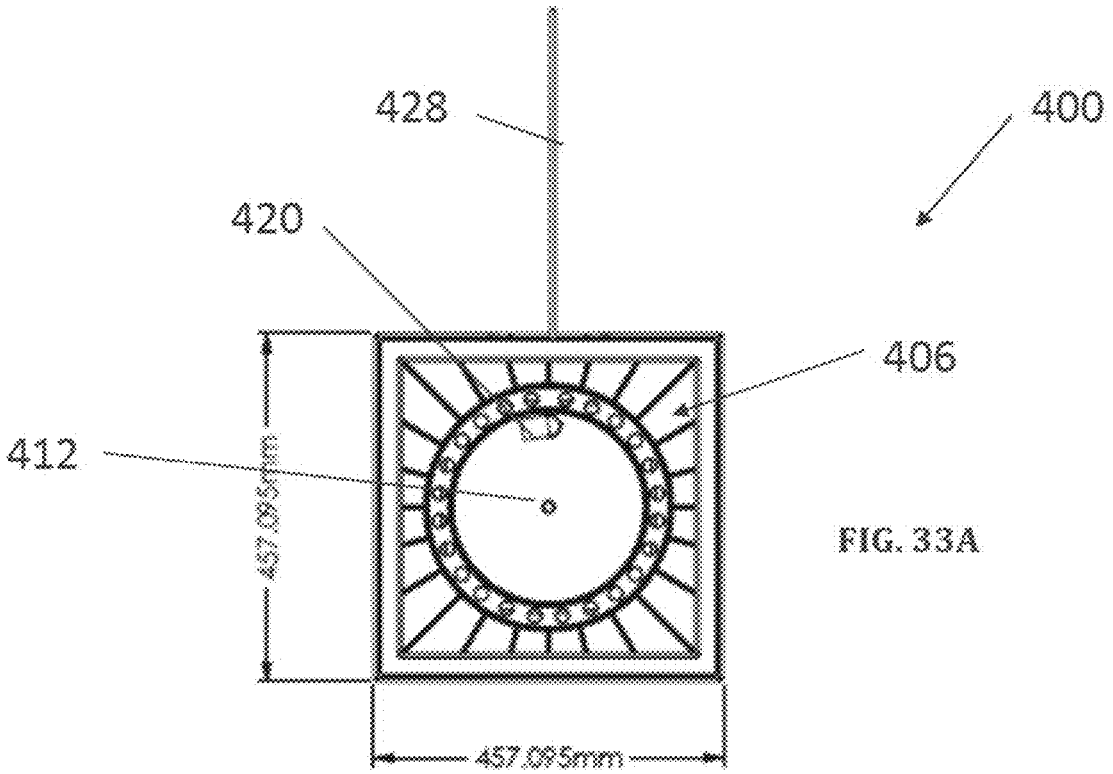
FIG. 33A is a top view of the fountain of FIG. 32.
Figure 33B:
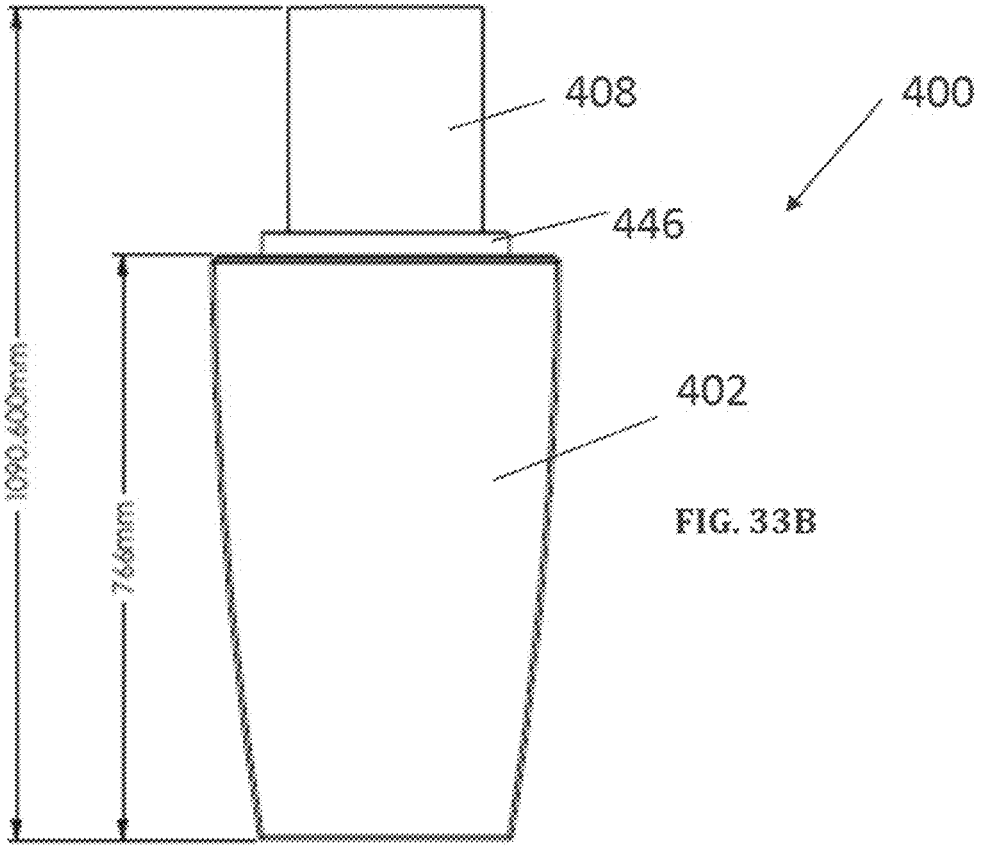
FIG. 33B is a side view of the fountain of FIG. 32.
Figure 34B:
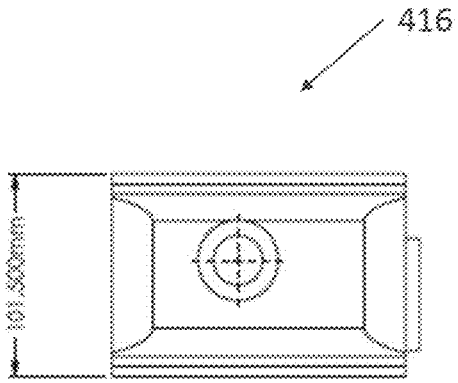
FIG. 34B is a top view of the pump of FIG. 34A.
Figure 34A:
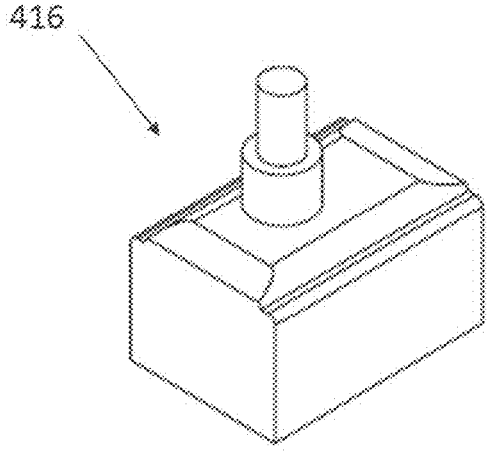
FIG. 34A is a front perspective view of an exemplary pump for use with the present invention.
Figure 34C:
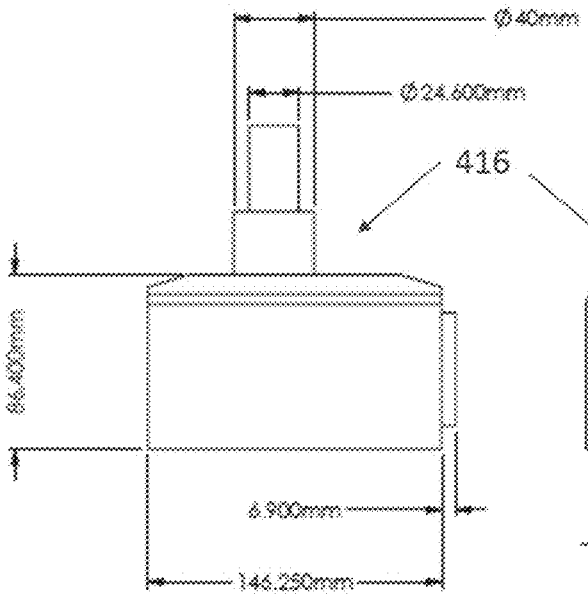
FIG. 34C is a side view of the pump of FIG. 34A.
Figure 34D:
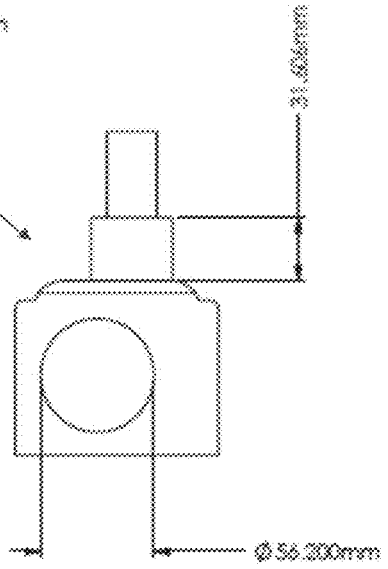
FIG. 34D is a rear view of the pump of FIG. 34A.

FIG. 32 through FIG. 33B illustrates another exemplary embodiment of the fountain 400 and FIG. 34A through FIG. 42C illustrates various components thereof. Please note that similar components have been numbered similarly, but increased by 100 (i.e., 304 to 402). However, while FIG. 34A-42C are described with respect to the embodiment shown in FIG. 32-33B it is contemplated that the components shown and described with respect to FIG. 34A-42C may be used with any of the embodiments shown and described herein.

Figure 39:
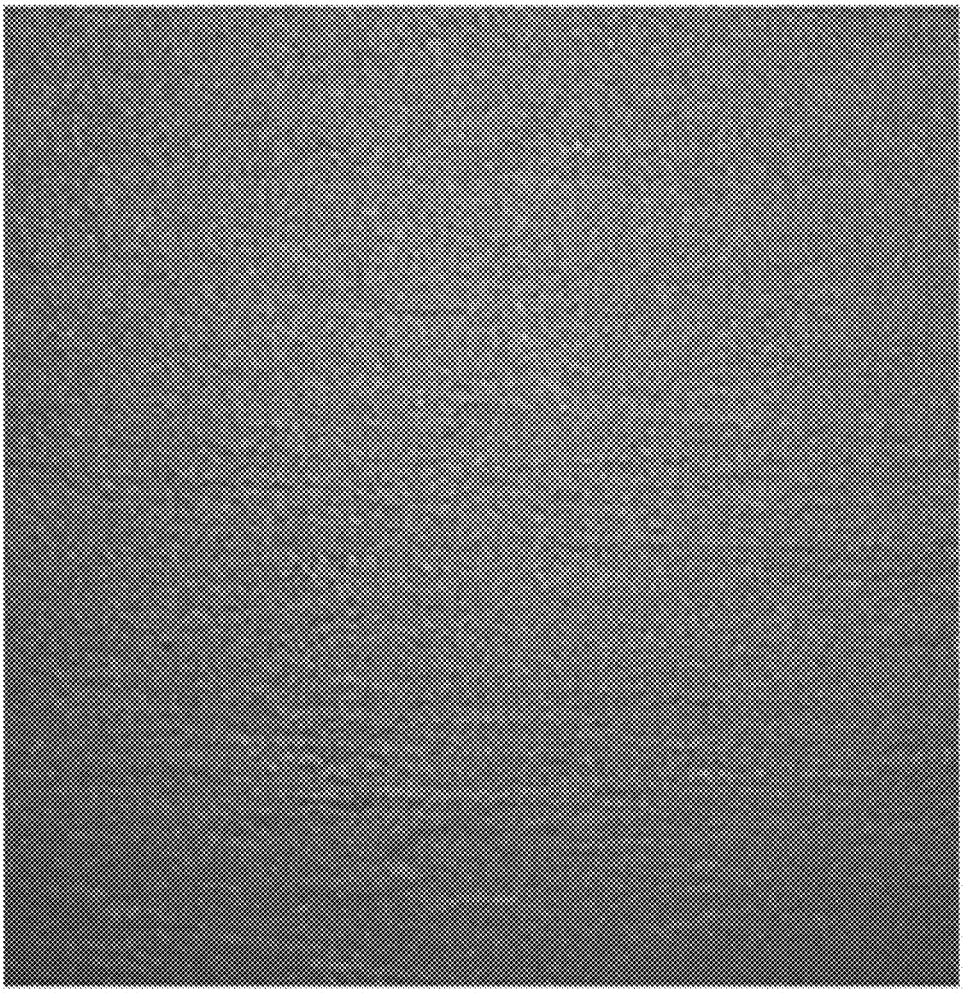
FIG. 39 is an exemplary external surface finishing for use with the present invention.

As best illustrated in FIG. 38A-FIG. 38E, a support base 402 may be substantially rectangular in shape but taper from top to bottom to provide an aesthetically pleasing appearance. The upper portion of the support base 402 may comprise a recessed section which extends along the upper perimeter thereof so as to receive a support rack 406. A depression 434 may be located in the upper edge of a side of the support base 402 to allow an electrical cord 428 or other items to pass therethrough. A lower reservoir 404 may be located within the support base 402, though in other exemplary embodiments the inner cavity formed by the support base 402 may be the lower reservoir 404. In exemplary embodiments, the outer surface of the support base 402 is textured as illustrated in FIG. 39 to provide an aesthetically pleasing appearance.

Figure 35B:
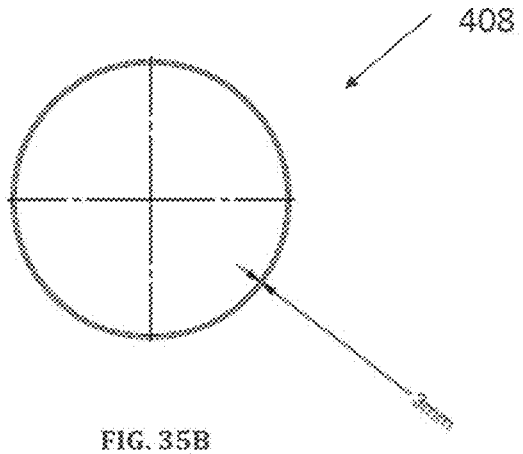
FIG. 35B is a top view of the upper tank of FIG. 35A.
Figure 35A:
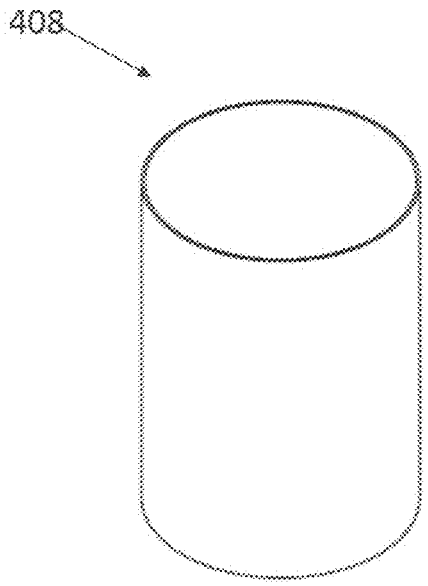
FIG. 35A is a front perspective view of an exemplary cylindrical upper tank for use with the present invention.
Figure 35C:
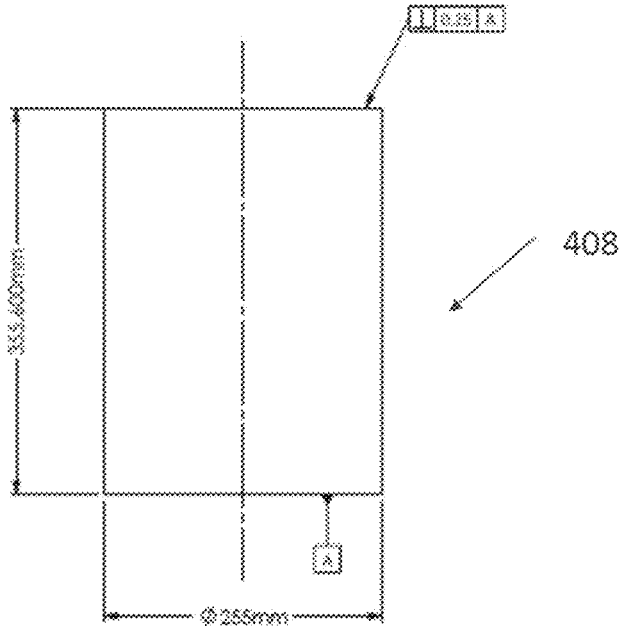
FIG. 35C is a front view of the upper tank of FIG. 35A.
Figure 36C:
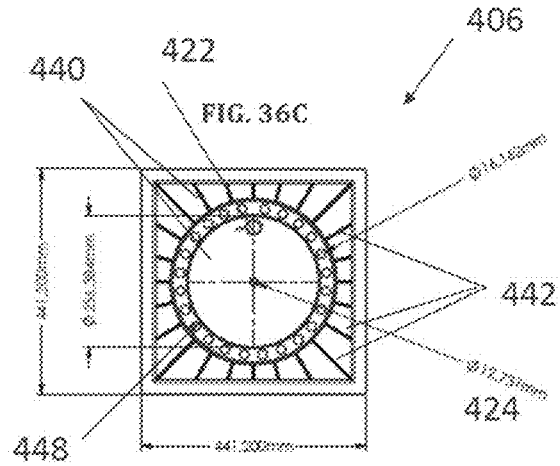
FIG. 36C is a top view of the support base of FIG. 36A.
Figure 36A:
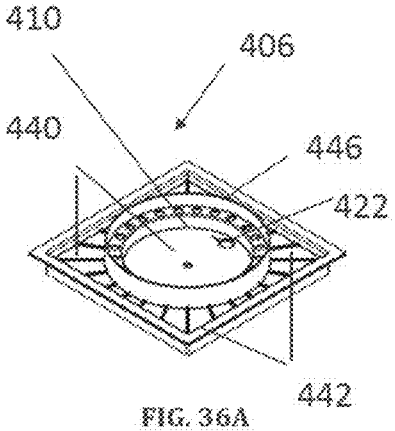
FIG. 36A is a top perspective view of an exemplary support rack for use with the present invention.
Figure 36D:
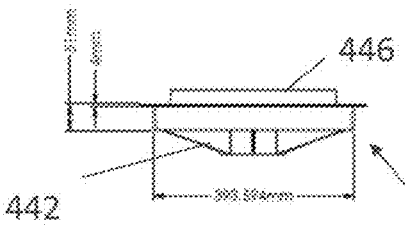
FIG. 36D is a side view of the support base of FIG. 36A.
Figure 36B:
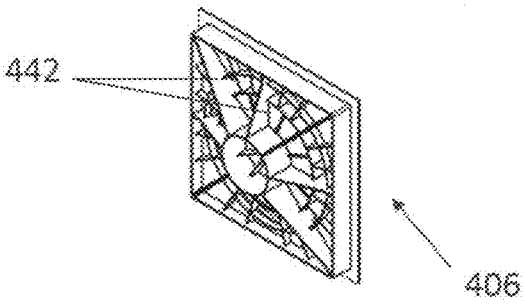
FIG. 36B is a rear perspective view of the support base of FIG. 36A.
Figure 36E:
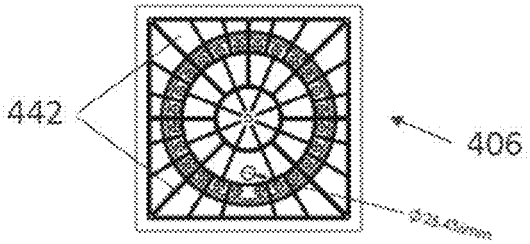
FIG. 36E is a bottom view of the support base of FIG. 36A.
Figure 37A:
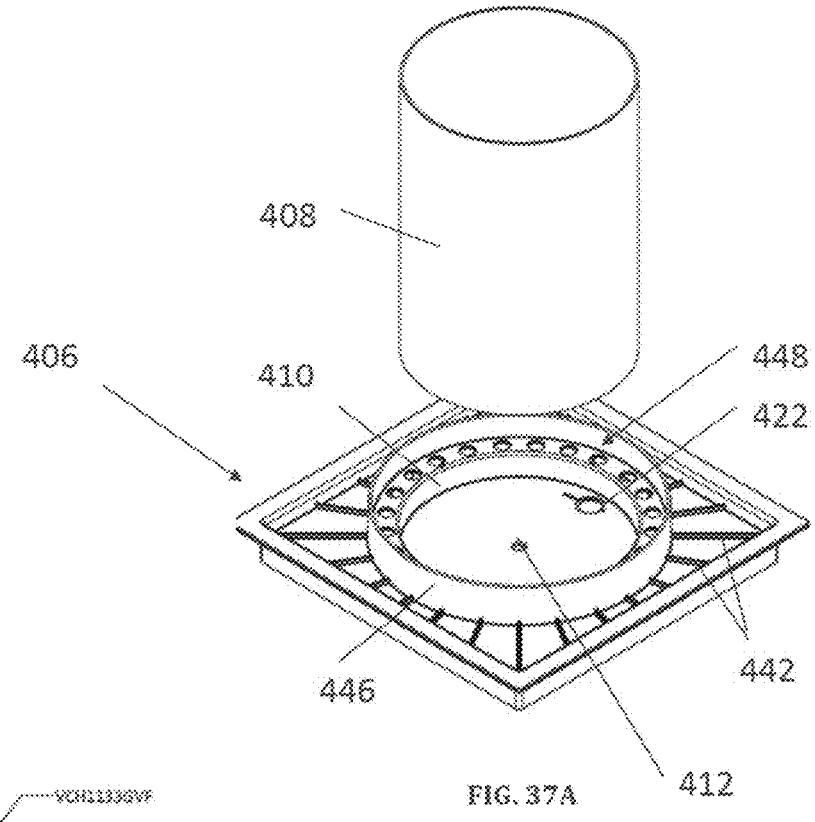
FIG. 37A is a front perspective exploded view of the exemplary cylindrical upper tank of FIG. 35A as installed on the exemplary support rack of FIG. 36A.
Figure 37C:
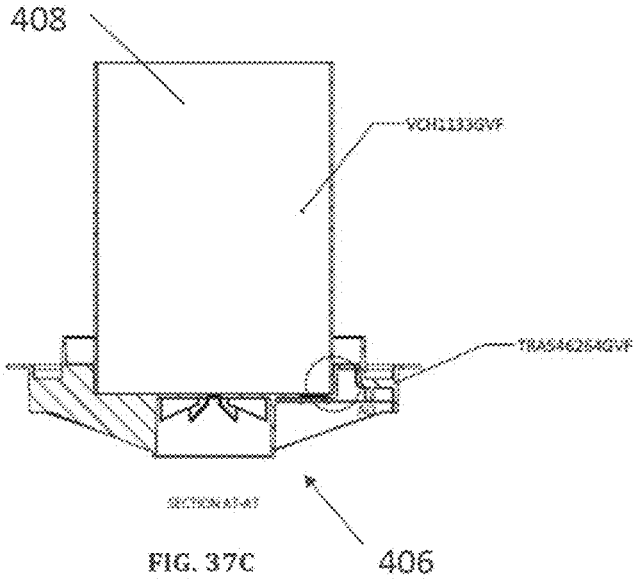
FIG. 37C is a side sectional view of the assembly of FIG. 37A taken along section line AT-AT of FIG. 37B.
Figure 37B:
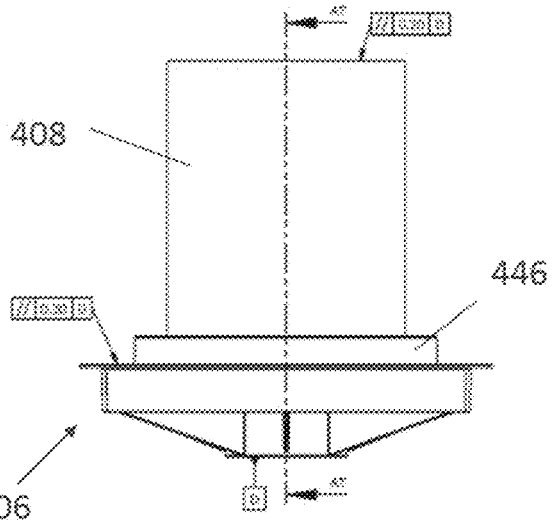

As best illustrated in FIG. 35A-35C a cylindrical upper tank 408 may be mounted to the top of the support base 406 and may contain the vortex.

As best illustrated in FIG. 36A-FIG. 37C, the support rack 406 may comprise a plate 440, a number of members 442, a center ring 410, and a second ring 446. The plate 440 may extend across the surface of the support rack 406 to receive various components, including but not limited to, the cylindrical upper tank 408. The members 442 may be arranged in a pattern or network and may be configured to extend through, above, and below the plate 440 to provide structural support and stiffness. The center ring 410 may be configured to receive and secure the cylindrical upper tank 408 by surrounding a portion thereof. The drain hole 412 may be located in substantially the center of the cylindrical upper tank 408 and the corresponding second aperture 424 may be located in the support rack below the drain hole 412. In this way, water from the cylindrical upper tank 408 may be drained straight down into the lower reservoir 404. An inflow hole 414 may be located in the cylindrical upper tank 408 which may correspond to a first aperture 422 located in the support rack 406. The inflow hole 414 may be positioned near the edge of the cylindrical upper tank 408 when the cylindrical upper tank 408 is installed and the first aperture 422 may be located below the inflow hole 414. In exemplary embodiments, the first aperture 422 may not be required and the inflow hole 414 may serve as the first aperture 422 or vice versa. Likewise, the second aperture 424 may not be required and the drain hole 412 may serve as the second aperture 424 or vice versa.

The inflow hole 414 may be configured to receive the elbow fitting 420, such as but not limited to the one shown in FIG. 40A-FIG. 40E. The elbow fitting 420 may comprise an upper and a lower portion wherein each portion is configured to extend substantially 90 degrees from the other. The lower portion of the elbow fitting 420 may extend through the inflow hole 414 and may comprise a lip for preventing the elbow fitting 420 from traveling therebeyond. The elbow fitting 420 may further comprise a series of threads on a lower portion thereof configured to receive a nut 430. An exemplary nut 430 is illustrated in FIG. 41A-FIG. 41D, though any type of nut 430 is contemplated. The nut 430 may be threaded to the elbow fitting 420 and may be secured to the bottom surface of the support rack 406 such that the elbow fitting 420 is secured via the lip, the inflow hole 414, and the nut 430. In exemplary embodiments, the elbow fitting 420 is placed such that the upper portion is configured to eject water along the inner wall of the cylindrical upper tank 408 so as to create a vortex.

The support rack 406 may further comprise a second ring 446 located substantially concentric to the center ring 410, though the second ring 446 is not required. The second ring 446 may extend vertically higher than the center ring 410. A series of apertures 448 may be located in the space between the center ring 410 and the second ring 446 and may be configured to allow water to drain into the lower reservoir 404. The support rack 406 may further comprise a rim, which may extend the outer perimeter of the support rack 406 so as to allow rocks or other decorative objects 126 to be placed on the plate 440 in the area between the rim and the second ring 446.

In exemplary embodiments, the members 446 may be tapered such that they have a greater height towards the center of the support rack 406 and a decreased height as the members 446 extend towards the edge thereof. Any number of additional support members 446 may extend in any direction above, below, or through the support rack 406 to provide additional strength and stability. This arrangement is merely exemplary, any grid, network, or arrangement of members 446 is contemplated. In other exemplary embodiments, the plate 440 may not extend in the area between the second ring 446 and the edge of the support rack 406 such that water is permitted to drain therethrough and into the lower reservoir.

FIGS. 34A-34D illustrate an exemplary pump 416 for use with the present invention. The pump 416 may be located in the lower reservoir 404 and may supply water to the cylindrical upper tank 408 to create the vortex. The water may travel from the pump 416 to the elbow fitting 420 via a tube 418 where it is then ejected into the cylindrical upper tank 408.

Figure 42A:
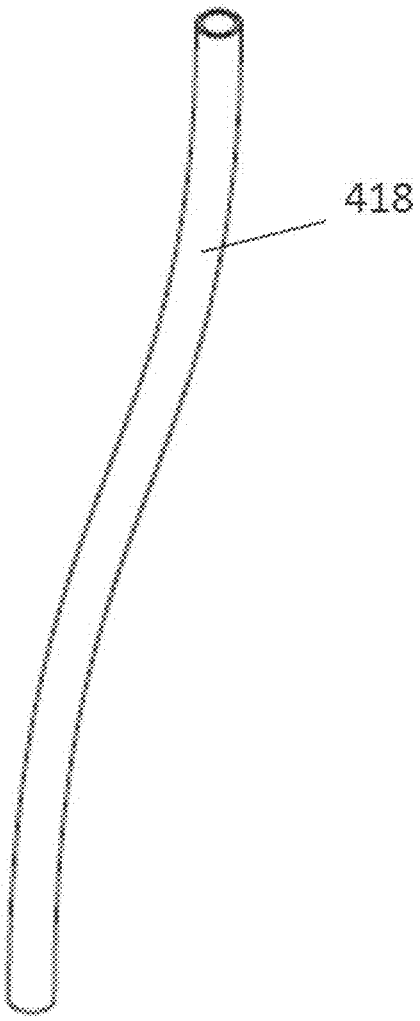
FIG. 42A is a front perspective view of an exemplary tube for use with the present invention.
Figure 42B:
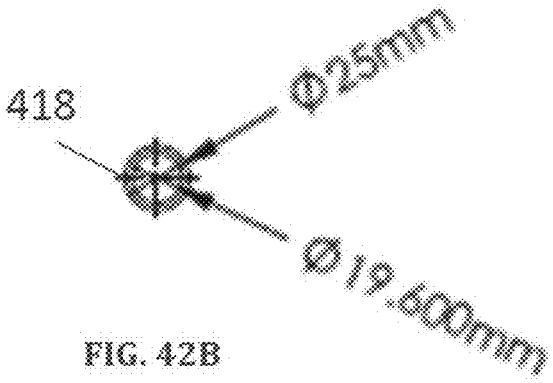
FIG. 42B is a top view of the tube of FIG. 42A.
Figure 42C:
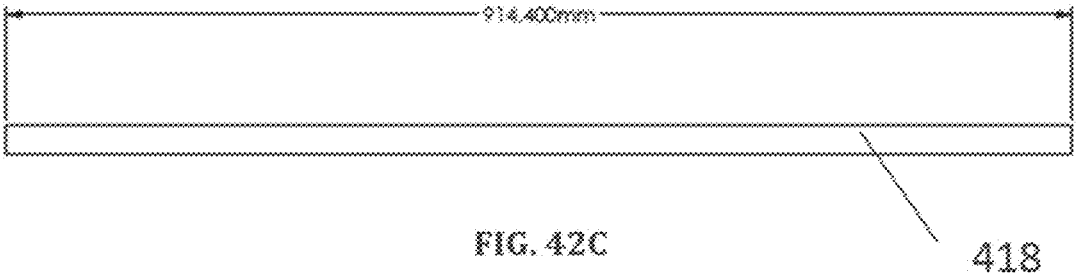
FIG. 42C is a side view of the tube of FIG. 42A.

An exemplary tube 418 is shown in FIGS. 42A-42C. The tube 418 may be flexible and may be comprised of a plastic, though any material is contemplated. The elbow fitting 420 may be tapered and/or comprise a series of ridges for securing the tube 418 to the lower portion of the elbow fitting 420, though this is merely exemplary. Any other means of securing the elbow 420 to the tube 418 is contemplated, such as but not limited to, by use of clamps.

In exemplary embodiments, various components of the fountain 400 may be sized, configured, positioned, or controlled so as to create a vortex in the cylindrical upper tank 408 when operated. For example, but not to serve as a limitation, the pump 416 may be configured or controlled to provide sufficient volumetric flow and water speed so as to create the vortex. The pump 416 may be controlled within a range so as to create various size, shape, and speed vortexes. For example, without limitation, the dashed lines in FIG. 22 and FIG. 31 illustrate exemplary vortices that may be created by the present invention.

While various components and features may be shown and described herein with respect to particular embodiment(s), it is contemplated that such components and features may be utilized with any of the various embodiments shown and described herein.

While the foregoing written description of the invention enables one of ordinary skill to make and use what is considered presently to be the best mode thereof, those of ordinary skill will understand and appreciate the existence of variations, combinations, and equivalents of the specific embodiments and examples herein. The invention should therefore not be limited by the above described embodiments, methods, and examples, but by all embodiments within the scope and spirit of the invention.

What is claimed is:

1. A fountain apparatus for creating a vortex and a secondary spillover effect, said fountain apparatus comprising:

a base housing;

a lower reservoir located within the base housing and configured to receive water;

a pump located in the lower reservoir and configured to pump the water when activated;

a support platform located on an upper portion of the base housing and comprising a plurality of overflow drain holes;

a cylindrical upper tank having an open top end, a bottom surface, and a sidewall, wherein said cylindrical upper tank is mounted to the support platform and said sidewall extends in an upward direction from said support platform, said cylindrical upper tank comprising:

a vortex drain hole located at a center portion of the bottom surface; and an inflow hole located at the bottom surface along the sidewall;

an elbow fitting extending through the inflow hole and configured to, when said pump is activated and the water is provided, eject the water tangential to a portion of the sidewall immediately adjacent to said elbow fitting, wherein said pump, when activated and said water is provided, is configured to generate sufficient flow of the water through said elbow fitting so as to fill the cylindrical upper tank with the water, cause an overflow portion of the water to flow over an upper edge of the sidewall and drain through the plurality of overflow drain holes into the lower reservoir, and create the vortex with a remaining portion of the water which forms a depression extending from the upper edge of said sidewall to said vortex drain hole for drainage into said lower reservoir; and tubing extending from the pump to the elbow fitting for transporting the water from the lower reservoir to the elbow fitting when said pump is activated and the water is provided;

wherein said plurality of overflow drain holes are located beyond the sidewall of the cylindrical upper tank such that said plurality of overflow drain holes are located outside of said cylindrical upper tank to capture said overflow portion of the water creating the secondary effect.

2. The fountain apparatus of claim 1 further comprising:

a first aperture located on the support platform and positioned below the vortex drain hole to permit the remaining portion of the water to drain therethrough and into said lower reservoir; and a second aperture located on the support platform and positioned below the inflow hole to permit the elbow fitting or the tubing to extend therethrough.

3. The fountain apparatus of claim 1 further comprising:

a cylindrical shaped ring located on, and extending in an upward direction from, the support platform and sized to surround the sidewall of the cylindrical upper tank.

4. The fountain apparatus of claim 3 further comprising:

a second, cylindrical shaped ring located on, and extending in an upward direction from, the support platform, wherein the second ring is concentric with the ring and has a larger diameter than the ring, wherein the plurality of overflow drain holes are located on the support platform between the ring and the second ring, and wherein said second ring is sized to provide a gap between said second ring and an outer boundary of said support platform.

5. The fountain apparatus of claim 1 wherein:

the support platform comprises:

a plate located below the cylindrical upper tank; and a number of rigid members extending along one or more surfaces of said plate.

6. The fountain apparatus of claim 1 wherein:

the base housing defines a cavity; and the lower reservoir comprises the cavity.

7. The fountain apparatus of claim 1 wherein:

the support platform comprises a grid of members.

8. The fountain apparatus of claim 1 wherein:

the cylindrical upper tank is integrally formed with the support platform.

9. The fountain apparatus of claim 1 further comprising:

a depression located in the base housing for receiving an electrical cord to provide power to the pump.

10. A fountain apparatus for creating a vortex and a secondary spillover effect, said fountain apparatus comprising:

a base defining, at least in part, a reservoir having an upper opening and configured to receive water;

a pump located in the reservoir for pumping the water when activated;

a receptacle having a hollow cylindrical shape with an open top and a sidewall;

a support platform covering at least a majority of the upper opening, wherein the receptacle is positioned on, and extends in an upward direction from, an upper surface of said support platform;

a vortex drain hole located at a central portion of a bottom of the receptacle;

an inflow hole located along a sidewall of the receptacle;

a number of overflow drain holes located in said support platform beyond the sidewall of the receptacle, wherein each of said number of overflow drain holes are configured to permit an overflow portion of the water from the receptacle to pass into the reservoir;

an elbow extending through the inflow hole and configured to direct ejection of the water along a portion of the sidewall immediately adjacent to the elbow and permit sufficient flow of the water through the elbow to fill the receptacle with the water, cause the overflow portion of the water in the receptacle to spill out the open top of the receptacle for drainage through the number of overflow drain holes into the reservoir, and create the vortex with a remaining portion of the water in the receptacle; and tubing extending from the pump to the elbow for transporting the water from the reservoir to the elbow when said pump is activated and the water is provided;

wherein at least said pump is configured to, when activated and the water is provided, fill the receptacle with the water, cause the overflow portion of the water within the receptacle to spill out the open top of the receptacle and along an outer surface of the sidewall to the number of overflow drain holes, and create the vortex with the remaining portion of the water in the receptacle, wherein said vortex, once fully formed, defines a depression extending from the open top of said receptacle to said vortex drain hole.

11. The fountain apparatus of claim 10 further comprising:

a series of stiffeners extending along an inner wall of said base, wherein said stiffeners are configured to support said support platform.

12. The fountain apparatus of claim 10 wherein:

said reservoir is integrally formed with said base; and said reservoir is configured to support said support platform.

13. The fountain apparatus of claim 10 wherein:

said support platform is configured to receive aggregate.

14. The fountain apparatus of claim 10 wherein:

the support platform, the receptacle, and the elbow are integrally formed.

15. The fountain apparatus of claim 10 wherein:

the vortex drain hole is located in the support platform.

16. The fountain apparatus of claim 10 wherein:

the receptacle comprises a bottom surface; and the vortex drain hole is located in the bottom surface.

17. The fountain apparatus of claim 10 further comprising:

a ring having a cylindrical shape and extending in an upward direction from the support platform, wherein the ring is sized to fit around the sidewall of the receptacle and is at least as tall as the elbow.

18. A fountain apparatus for creating a vortex and a secondary spillover effect, said fountain apparatus comprising:

a base defining an upper opening and comprising a number of tapered sidewalls at least partially defining a reservoir, configured to accept water for creating the vortex and the secondary spillover effect; a pump located in the reservoir of the base;

a tank shaped as a hollow cylinder and having an open upper end;

a support platform covering the upper opening, said support platform comprising:

a plate which supports the tank;

a number of support members located below, and extending along, said plate;

a ring surrounding an outer surface of a sidewall of the tank; and a series of overflow drain holes spaced apart from one another in an annular arrangement about the ring beyond an outer surface of a sidewall of the tank such that said series of overflow drain holes are located outside of said tank;

wherein said tank is located at, and at least a portion extends above, said support platform;

an inflow hole located adjacent to an inner surface of the sidewall of the tank;

an elbow extending through the inflow hole and positioned to, when said pump is activated and said water is provided, direct election of the water along the inner surface of a portion of the sidewall of the tank immediately adjacent to said elbow;

a vortex drain hole located at the center of the plate; and a tube connecting the pump to the elbow for transporting the water from the reservoir to the elbow when said pump is activated and the water is provided;

wherein at least said pump, said drain hole, and said elbow are configured to, when said pump is activated and said water is provided, fill said tank with the water, spill an overflow portion of the water in the tank to out the open upper end of the tank and along the outer surface of the sidewall of the tank to the series of overflow drain holes for draining into the reservoir of the base, thereby creating the secondary effect, and create the vortex with a remaining portion of the water in the tank for draining into said vortex drain hole, wherein said vortex, once fully formed, defines a depression extending from said open upper end of said tank to said vortex drain hole.

* * * * *